US009546840B1

(12) United States Patent
Bartell et al.

(10) Patent No.: US 9,546,840 B1
(45) Date of Patent: Jan. 17, 2017

(54) BI-DIRECTIONAL RECOIL CONTAINMENT AND DOUBLE STRIKE PREVENTION SYSTEM

(71) Applicants: William Bartell, Hackettstown, NJ (US); Thomas Tighe, Morris Township, NJ (US); Matthew Tomik, Easton, PA (US); Noah Gordon, Metuchen, NJ (US)

(72) Inventors: William Bartell, Hackettstown, NJ (US); Thomas Tighe, Morris Township, NJ (US); Matthew Tomik, Easton, PA (US); Noah Gordon, Metuchen, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/596,662

(22) Filed: Jan. 14, 2015

(51) Int. Cl.
*F41A 25/10* (2006.01)
*F41A 19/13* (2006.01)
*F41A 25/12* (2006.01)

(52) U.S. Cl.
CPC ..... *F41A 25/12* (2013.01)

(58) Field of Classification Search
CPC ..... F41A 1/08; F41A 1/10; F41A 5/05; F41A 5/10; F41A 5/12; F41A 5/14; F41A 5/16; F41A 5/18; F41A 5/22; F41A 19/28; F41A 19/27; F41A 19/29; F41A 3/70; F41A 3/68; F41A 3/88; F41A 17/10; F41A 17/12; F41A 17/30; F41A 17/32;F41A 17/42; F41A 17/64; F41A 19/13; F41A 1/00; F41A 1/06; F41A 25/10; F41A 25/12; F41A 25/14; F41A 25/22
USPC ..... 89/1.35
See application file for complete search history.

(56) References Cited

U.S. PATENT DOCUMENTS 681,109 A * 8/1901 Dawson et al. ..... F41A 19/13 74/501.6
2,089,671 A * 8/1937 Stecke ..... F41A 3/46 89/151
2,167,672 A * 8/1939 Nomar ..... F41A 3/38 89/132
2,399,432 A * 4/1946 Gazda ..... F41A 3/12 89/151
2,413,703 A * 1/1947 Fischer ..... F41A 25/18 267/75
2,484,053 A * 10/1949 Rosenkrantz ..... F41A 3/08 89/1.35
2,503,309 A * 4/1950 Weiss ..... F41A 19/13 42/69.01
2,512,014 A * 6/1950 Eglin ..... F41A 19/28 89/151

(Continued)

*Primary Examiner* — Bret Hayes
*Assistant Examiner* — Derrick Morgan
(74) *Attorney, Agent, or Firm* — Michael C. Sachs

(57) ABSTRACT

An active soft recoil control system that provides a bi-directional recoil containment and double strike prevention, which improves recoil force management, reduces the potential for "short" rounds, results in a more compact and lighter weight weapon, and increases the uniform performance of the heavy weapon at temperature extremes and steep cants. Furthermore, the present system provides for a mechanism that enables safer firing pin retraction and reduces the potential for unintentionally striking the primer and initiating the round during misfire operations.

17 Claims, 21 Drawing Sheets

(56) References Cited

U.S. PATENT DOCUMENTS 2,549,162 A * 4/1951 Blacker ..... F41A 3/38 89/176
2,563,721 A * 8/1951 Guisasola ..... F41A 19/28 89/151
2,590,981 A * 4/1952 Lippert ..... F41A 3/38 102/469
2,597,031 A * 5/1952 Posey ..... F41F 1/06 89/1.35
2,779,242 A * 1/1957 Willhauck ..... F41A 5/32 89/152
2,790,357 A * 4/1957 Garrett ..... F41A 25/18 89/37.05
2,800,057 A * 7/1957 Hoopes ..... F41A 19/37 89/28.05
2,876,681 A * 3/1959 Maier ..... F41A 25/14 89/198
3,431,820 A * 3/1969 Schnatter ..... F41A 9/47 42/105
3,782,240 A * 1/1974 Feldmaier ..... F41A 17/64 89/1.35
3,848,510 A * 11/1974 Wolpert ..... F41A 3/46 89/173
3,892,163 A * 7/1975 Asikainen ..... F41F 1/06 89/25
3,969,982 A * 7/1976 Pier-Amory ..... F41A 25/12 89/178
4,227,439 A * 10/1980 Gillum ..... F41A 3/40 89/180
4,269,109 A * 5/1981 Stoner ..... F41A 3/82 89/132
4,311,082 A * 1/1982 Johnson ..... F41A 9/37 89/185
4,329,908 A * 5/1982 Rowlands ..... F41A 19/70 89/24
4,467,697 A * 8/1984 Witt ..... F41A 5/22 89/191.01
4,506,589 A * 3/1985 Junker ..... F41A 3/40 89/190
5,410,942 A * 5/1995 Begneu ..... F41A 19/29 42/84
5,726,376 A * 3/1998 Menges ..... F41A 17/76 42/70.08
6,450,080 B1 * 9/2002 Pochard ..... F41A 19/38 89/27.14
6,851,348 B1 * 2/2005 Ang ..... F41A 13/04 89/1.2
7,555,977 B2 * 7/2009 Crotty ..... F41F 1/06 89/1.35
7,779,740 B1 * 8/2010 Holmes ..... F41A 17/66 42/70.08
7,950,178 B1 * 5/2011 Landies ..... F41A 19/27 42/69.01
8,297,174 B1 * 10/2012 Russell ..... F41A 25/12 89/37.14
8,356,437 B1 * 1/2013 Holmes ..... F41A 9/53 42/1.01
8,661,962 B1 * 3/2014 Hart ..... F41A 25/12 235/404
9,435,602 B1 * 9/2016 Tomik ..... F41A 25/10
2012/0000348 A1 * 1/2012 Stromberg ..... F41A 1/08 89/1.7

* cited by examiner

BI-DIRECTIONAL RECOIL CONTAINMENT AND DOUBLE STRIKE PREVENTION SYSTEM

GOVERNMENTAL INTEREST

The invention described herein may be manufactured and used by, or for the Government of the United States for governmental purposes without the payment of any royalties thereon.

FIELD OF THE INVENTION

The present invention relates in general to the field of weapons. Specifically, this invention relates to an active soft recoil control system that provides a bi-directional recoil system and double strike prevention mechanism which improves recoil force management, reduces the potential for "short" rounds, results in a more compact and lighter weight weapon, and increases the uniform performance of the heavy weapon at temperature extremes and steep cants. More specifically, the present invention provides for a mechanism that enables safer firing pin retraction and reduces the potential for unintentionally striking the primer and initiating the round during misfire operations.

BACKGROUND OF THE INVENTION

In a soft recoil weapon system, a recoiling mass generally refers to the components that move in response to the firing energy and may encompass, for example, a breech or a ramming mechanism, recoil cylinders, recoil springs, and firing mechanism. The rearward impulse of firing the weapon, is partially cancelled by the forward momentum of the recoiling mass at the time of firing.

The recoiling mass is normally held out-of-battery by a latch mechanism against a series of compression springs. When the latch mechanism is released, the recoiling mass is accelerated forward by the compression springs. The pressure created by the ignition of the propellant gases will launch the projectile forward and will launch the recoiling mass rearward, against the force created by the compression springs.

When designing a soft-recoil system a balance is sought between the forward momentum of the recoil system and the firing impulse, to ensure that the round fires and the weapon relatches, while minimizing recoil forces. Since the weapon must perform under a variety of conditions, including variations in ambient temperatures and propellant performance as well as weapon orientations (quadrant elevations) and platform cants (slopes), it becomes necessary to compensate for these variations, in order to ensure latching and to minimize recoil loads.

Conventionally, hydro-pneumatic recoil systems are utilized on large-caliber weapons to accomplish this task, while some small caliber systems utilize ring springs.

The need to maintain relatively low recoiling loads so that the weapons can be mounted onto light mobile platforms, is further complicated by other factors. These factors include for example, ignition delays, the ability to react to abnormally high impulses, the ability to perform at greater temperature extremes, and the ability to perform at greater weapon cant.

Ignition delays may, in extreme cases, defeat the advantages of soft recoil. For instance, by the time the mortar cartridge ignites, the forward momentum of the recoiling mass is reduced to zero. In this case, the recoil forces increase significantly, making the weapon system less practical for light mobile platforms. Certain conventional weapons have addressed this problem by allowing a portion of the combustion gases to vent past the breech seal, thereby reducing the rearward momentum. However, this arrangement may reduce the muzzle velocity of the projectile.

Weapons must also be designed to withstand the largest expected chamber pressure for safe operation under the most extreme operating conditions. This pressure, known as the PMP (permissible individual maximum pressure) may be typically as high as 50% greater than ambient temperature firing pressures. Statistically, these conditions may arise 3 times per 10,000 rounds fired, but result in greatly increased recoil forces. The traditional method of addressing this concern is to either increase the recoil distance to keep the forces to an acceptable level, or to design larger, more durable components.

Additionally, mobile platforms must be able to engage a variety of targets under various environmental extremes, with increased quadrant elevation ranges, and be able to fire at a variety of platform orientations and cants. These factors tend to require reducing the forward momentum of the recoiling parts in order to guarantee latching, which in turn results in higher recoiling forces.

Conventional soft recoil weapon systems are faced with the problem of actively controlling the recoil velocity to compensate for atypical or extreme firing conditions, such as firing at temperature extremes, firing on severe cants, or when firing results in a late ignition. Variations in the conditions of the soft recoil systems can result in system malfunction or even failure.

The prominent issue with these conditions is that soft recoil systems are dependent upon timing and load balances. More specifically, situational firing conditions can cause the following recoil extremes:

1—The recoiling parts do not have sufficient velocity to re-latch after firing, requiring the user to re-cock the weapon.

2—The recoiling parts have excessive velocity, causing high recoil forces and/or weapon damage.

3—Venting propelling gases reduces muzzle velocity, which reduces flight distance and prevents the round from reaching its intended target, thereby potentially endangering friendly troops and/or civilians.

4—Retraction of the rammer to get firing pin to safe position is inherently dangerous.

5—Increased trunnion forces, as a result of delayed ignition or permissible individual maximum pressure (PMP) rounds, require increased weight of latches, pedestal, and cradle which leads to mobility and payload issues.

The conventional methods for addressing the foregoing problems include for example:

1—Increasing the recoil stroke to keep firing loads within vehicle limits for permissible individual maximum pressure (PMP), late ignition, and vehicle cant conditions (increases overall weapon length and weight).

2—Reducing late ignition recoil loads by venting a portion of the propelling gases during firing (reduces muzzle velocity which results in a "short" round).

3—Increasing the size and load carrying capability of the latch mechanisms.

4—Limiting allowable firing conditions to a narrower ambient temperature and shallower cant angles.

While the foregoing conventional methods provided a certain level of control to the soft recoil weapon systems, there still remains a need for a more efficient, active soft recoil control system that provides a bi-directional recoil containment, double strike prevention, and firing pin retraction.

SUMMARY OF THE INVENTION

The present invention addresses the foregoing concerns and presents a new active soft recoil control system that provides a bi-directional recoil containment and double strike prevention system which improves recoil force management, reduces the potential for "short" rounds, results in a more compact and lighter weight weapon. Furthermore, the present invention provides for a mechanism that enables safer firing pin retraction and reduces the potential for unintentionally striking the primer and initiating the round during misfire operations.

The bi-directional recoil containment and double strike prevention system permits the weapon to perform uniformly over ambient temperature extremes and steep cants, achieving loads low enough to allow firing while mounted on light vehicle. It permits the firing pin to be safely removed during a misfire condition and for inspection purposes. It automatically retracts the firing pin after the recoil system forward travel stops, to provide safer misfire resolution. It also provides energy absorption of both firing and latching loads to reduce reaction forces.

More specifically, as the recoiling mass is moving forward, a firing cam and a safeing cam travel along their respective stationary cam paths by means of rollers. The cam paths control the motion of the firing cam and the safeing cam during the forward and subsequent backward motion of the recoiling mass. The motion of the safeing cam prevents the firing pin from protruding until the recoiling mass has moved to a position where pin protrusion (and subsequent mortar cartridge ignition) is desirable. When the recoiling mass has reached the desirable firing position, the safeing cam will rotate out of the way, allowing the firing cam to independently rotate, permitting the firing pin to protrude, thereby causing ignition of the round.

In the event of a misfire, in which the round does not ignite as expected, the recoiling mass will subsequently translate further forward than during normal cartridge ignition. In this event, the firing cam will rotate back, allowing the safeing cam to pull the firing pin to its retracted position. This is a significant safety improvement over prior fielded systems. First, it guarantees that the firing pin is safely retracted, preventing an inadvertent ignition. Second, when firing at high quadrant elevation, it protects the weapon from experiencing high recoil forces (after forward motion of the recoil system has stopped) as a result of the round dropping back onto the firing pin and initiating.

Another aspect of the present invention is the incorporation of a trim brake mechanism or recoil brake. The trim brake mechanism is an energy absorption mechanism that controls the forward and rearward velocities of the recoiling mass, regardless of the firing conditions. If the forward velocity were higher than normal (due perhaps to firing with the platform facing down a hill), the trim brake mechanism senses the velocity deviation resulting from such incline, and retards it to an acceptable level. If on the other hand, the rearward velocity is too high due to PMP pressure, low forward velocity, or an ignition delay, the trim brake mechanism can retard it, effectively absorbing the recoil energy.

The trim brake mechanism can be used both in a reactive and predictive fashion. For example, if a cant and quadrant elevation combination are known to cause increased forward velocity, a preplanned trim-braking amount can be applied. Associatively, if an increased velocity is detected, an estimated trim brake amount can be applied to negate the effect.

The incorporation of the trim brake mechanism makes it possible to eliminate the need to vent propellant gases or to incorporate bulky structures to withstand higher recoil forces.

The trim brake mechanism is mounted onto the weapon cradle and interfaces with the recoil mechanism by means of a straight gear rack. The translational motion of the recoil system during firing, imparts rotational motion to the trim brake. A solenoid controls the amount of force applied to the trim brake mechanism, thereby controlling the recoil velocity.

BRIEF DESCRIPTION OF THE DRAWINGS

The accompanying drawings, which are incorporated in, and constitute part of this specification, illustrate embodiments of the invention and together with the description, serve to explain the principles of the invention. The embodiments illustrated herein are presently preferred, it being understood, however, that the present invention is not limited to the precise arrangements and instrumentalities shown, wherein:

FIG. 10 includes FIGS. 10A and 10B, wherein FIG. 10A is an enlarged, cross-sectional view of the firing pin locking assembly of FIG. 9 shown in an unlocked state, and wherein

FIG. 11 includes FIGS. 11A and 11B, wherein FIG. 11A is an enlarged, cross-sectional view of the firing pin locking assembly of FIG. 9 shown in a locked state, and wherein

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
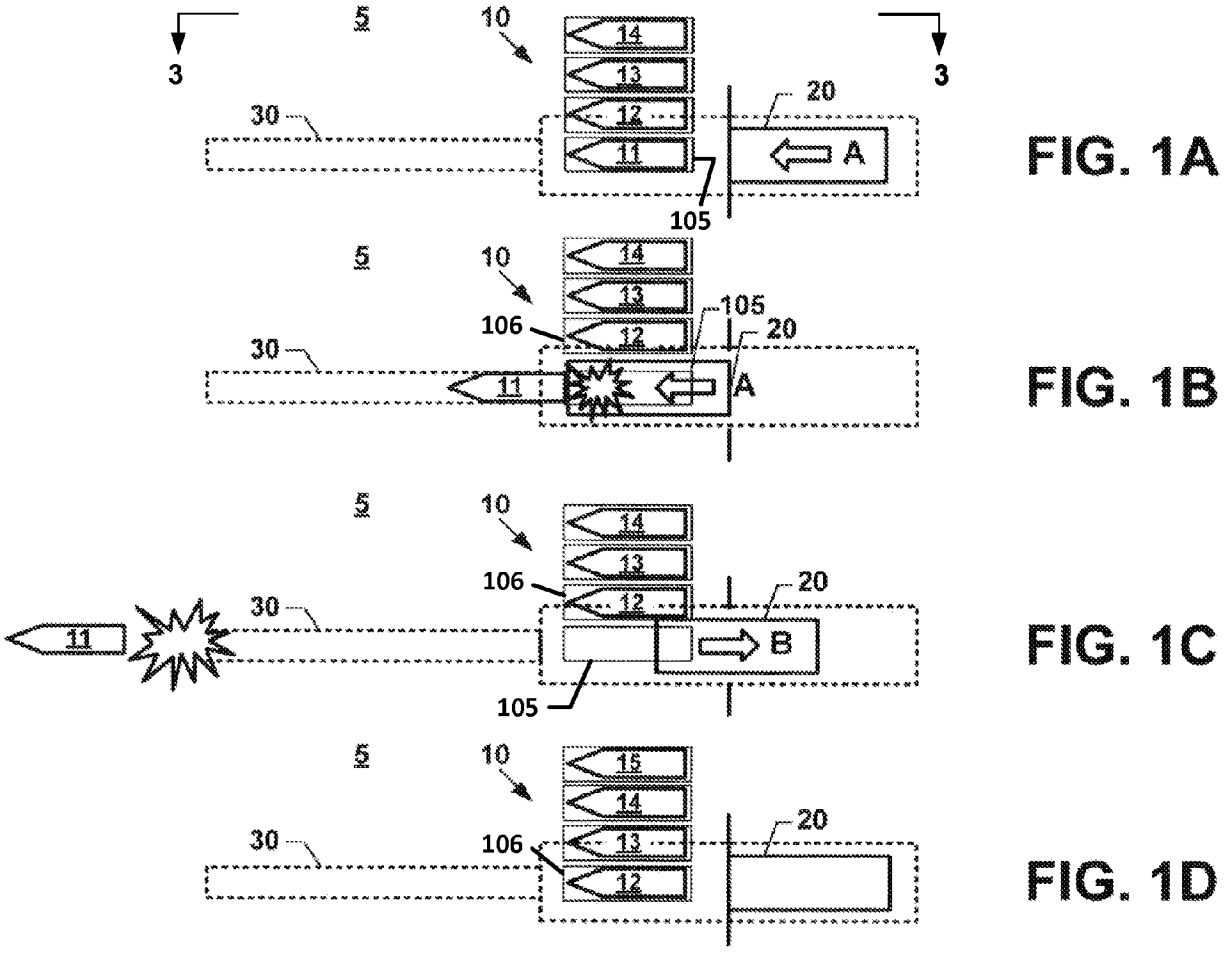
FIG. 1 includes FIGS. 1A, 1B, 1C, and 1D, and represents a schematic view of the operation of an automated weapon that is provided with an active soft recoil control system according to a preferred embodiment of the present invention.
Figure 2:
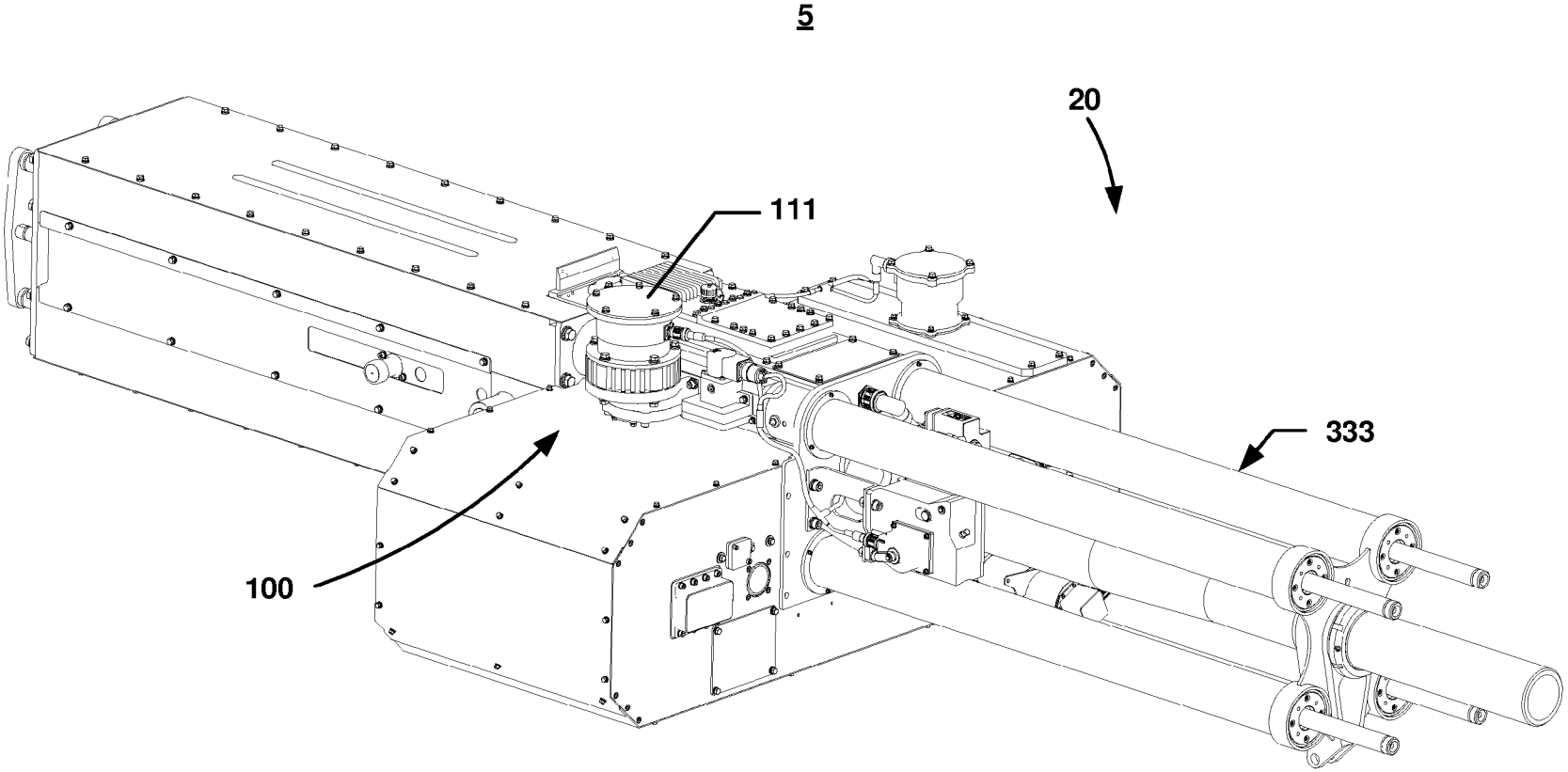
FIG. 2 is an isometric perspective view of an exemplary active soft recoil control system that forms part of the automated weapon of FIG. 1.

With reference to FIGS. 1 and 2, they illustrate an exemplary automated weapon 5 that is provided with an active soft recoil control system 100, according to a preferred embodiment of the present invention. In this example, the automated weapon 5 includes an ammunition feeding mechanism 10, a gun tube 30, and a recoiling mass 20 that translates back and forth within a firing chamber 25.

While the ammunition feeding mechanism 10 is shown as including four rounds 11, 12, 13, and 14, it should be clear that the ammunition feeding mechanism 10 can be provided with a different number of rounds, wherein each round, i.e., 11, 12, may be respectively stored in a storage cell, i.e., 105, as described in co-pending U.S. patent application Ser. No. 14/596,422, titled "Mortar Retention System For Automated Weapons," which is concurrently filed with the present application, and which is incorporated herein by reference in its entirety.

The general operation of the automated weapon 5 will now be described in connection with FIGS. 1A through 1D. FIG. 1A shows the first round 11 being advanced in line with the gun tube 30, and the recoiling mass 20 being cocked and latched. FIG. 1B shows the recoiling mass 20 unlatched and ramming the first round 11 forward, along the arrow A, causing the first round 11 to be fired through the gun tube 30. FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. It should be noted that the firing pin ignites the primer while the recoil is in motion, which is contrary to conventional recoil systems. FIG. 1D illustrates the recoiling mass 20 latched, with the ammunition feeding mechanism 10 indexed to the next round 12.

FIG. 2 illustrates the active soft recoil control system 100 of the present invention mounted on the recoiling mass 20 of the weapon 5, for adjusting the damping force of a mechanical recoil brake 111 during recoil and counter-recoil strokes, in order to enable efficient handle extreme firing conditions and the firing of multiple charges without hardware change. The design and operation of the recoil brake 111 are described in detail in co-pending U.S. patent application Ser. No. 14/596,573, titled "Active Recoil Control System," which is concurrently filed with the present application, and which is incorporated herein by reference in its entirety.

FIG. 2 further illustrates a bi-directional recoil mechanism 333 (also interchangeably referred to herein as soft recoil system or soft recoil containment system) that is secured to both the recoiling mass 20 and the recoil brake 111 for preventing double strike, improving recoil force management, and reducing the potential for "short" rounds. The bi-directional recoil mechanism 333 also provides for a mechanism that enables safer firing pin retraction according to the teaching of the present invention.

Figure 3:
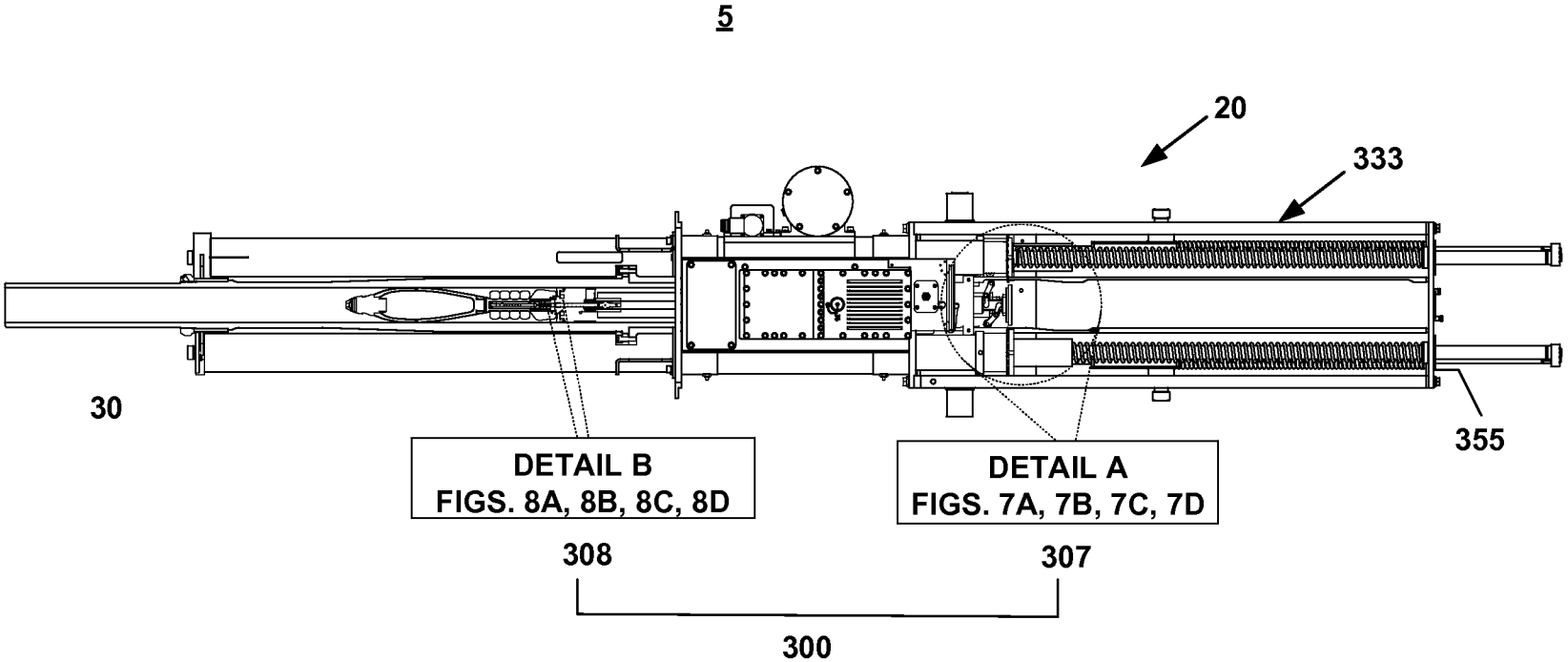
FIG. 3 is a partly cross-sectional view of the automated weapon of FIG. 1A, taken along line 3-3 thereof, showing a projectile inside a gun tube of the automated weapon, and further illustrating a bi-directional recoil mechanism, and a double strike prevention system comprised of a pin retraction mechanism (Detail A) and a firing pin assembly (Detail B), according to an exemplary embodiment of the present invention.

FIG. 3 is a cross-sectional view of the automated weapon 5 of FIG. 1A, taken along line 3-3 thereof, illustrating the bi-directional recoil mechanism 333, and the projectile 11 inside the gun tube 30. As stated herein, the present invention can be used in systems that employ soft recoil, such as mortar systems, to reduce recoiling forces. In a soft recoil system, the rearward momentum of the weapon 5, as a result of firing, is partially cancelled by the forward momentum of the recoiling mass 20 at the time of firing.

Figure 4A:
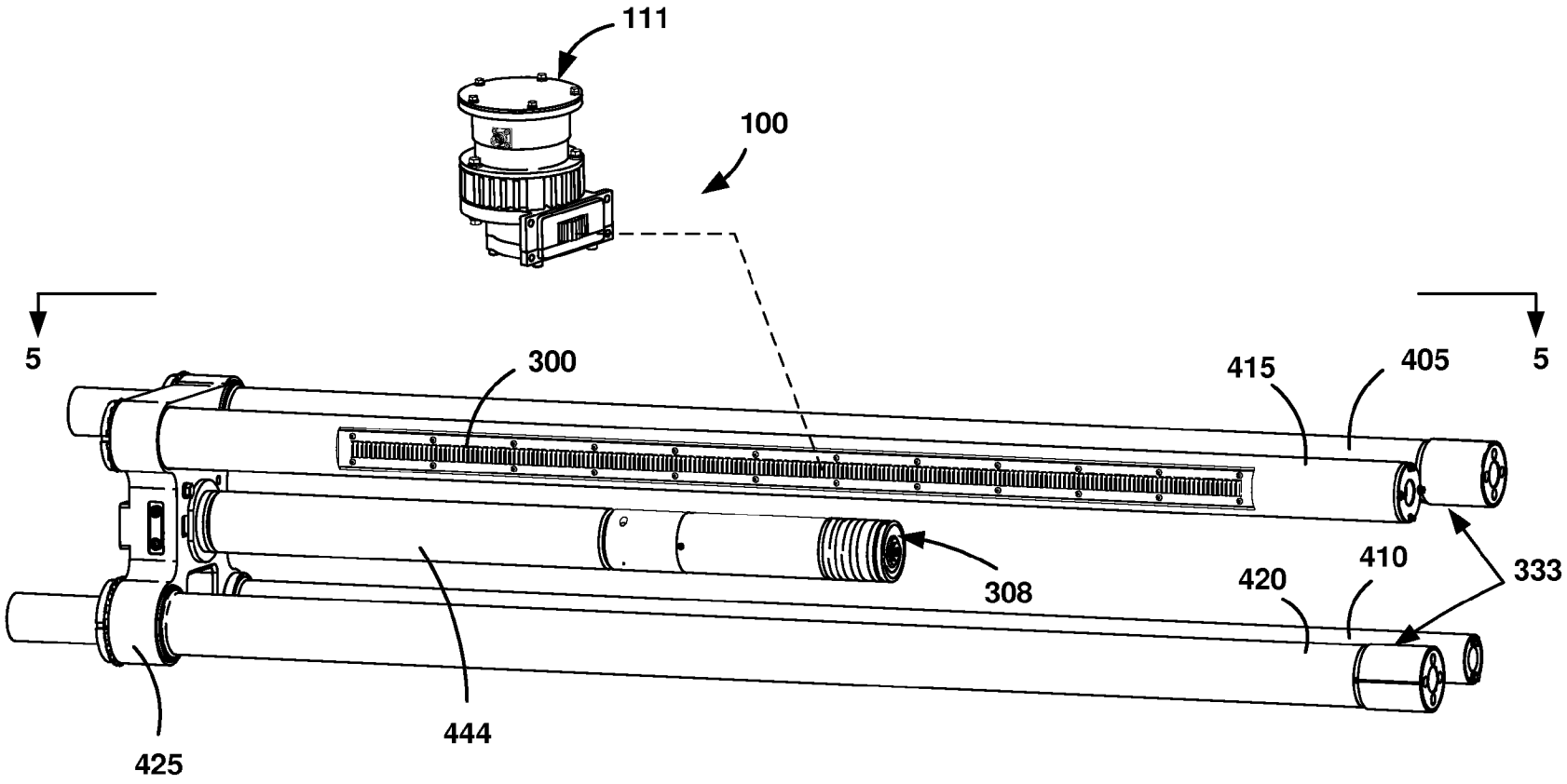
FIG. 4A is an enlarged, isometric, perspective view of the recoil mass of FIG. 3, illustrated as comprising four pistons that surround an axially disposed rammer (or breech)
Figure 4B:
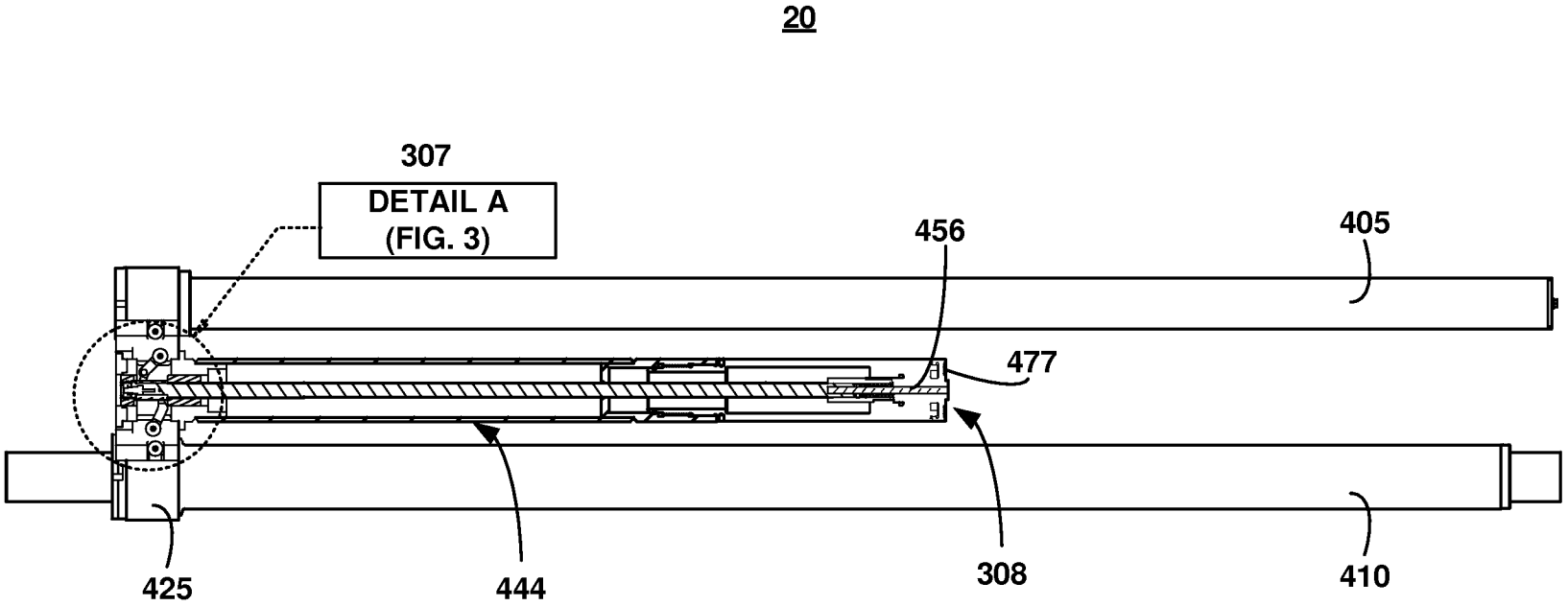
FIG. 4B is a partly cross-sectional view of the recoil mass of FIG. 4A, taken along line 5-5 thereof.

FIGS. 4A and 4B illustrate the recoil mass 20 of FIG. 3 as comprising four pistons (or cylinders) that surround an axially disposed rammer (or breech) 444, and a rear bracket 425 that engages the rear ends of the four pistons 405, 410, 415, 420. The bi-directional recoil mechanism is contained within pistons 405 and. A gear track 430 is formed on one of the pistons, i.e., 415, for engaging a trim brake mechanism 111, as explained in more detail in the afore-listed co-pending U.S. patent application Ser. No. 14/596,573, titled "Active Recoil Control System."

The recoil mass is normally held out of battery by a known or available latch mechanism (not shown) against a series of known or available compression springs (not shown). When the latch mechanism is released, the recoiling mass 20, including the bi-directional recoil mechanism 333, is accelerated forward by the compression springs.

When designing the soft recoil system of the automated weapon 5, a balance is sought between the forward momentum of the recoiling mass 20 and the firing impulse, to ensure that the round 11 fires and that the weapon 5 relatches, while minimizing recoil forces. Since the weapon 5 may perform under a variety of conditions, including variations in ambient temperatures and propellant performance as well as weapon orientations (quadrant elevations) and platform cants, and because if latching does not occur the weapon must be brought back into latch by a secondary charging mechanism and will result in reduced rate of fire, it is necessary to incorporate bi-directional recoil mechanism 333 to compensate for these variations, in order to ensure latching, and to minimize the recoil loads.

Typically, hydro-pneumatic recoil systems are utilized on large-caliber weapons to accomplish this task, while some small caliber systems utilize ring springs. The present invention utilizes ring springs, i.e., 501 (FIG. 5) that are arranged in a novel manner, so that they absorb energy bi-directionally, that is both in the forward and rearward directions.

Figure 5:
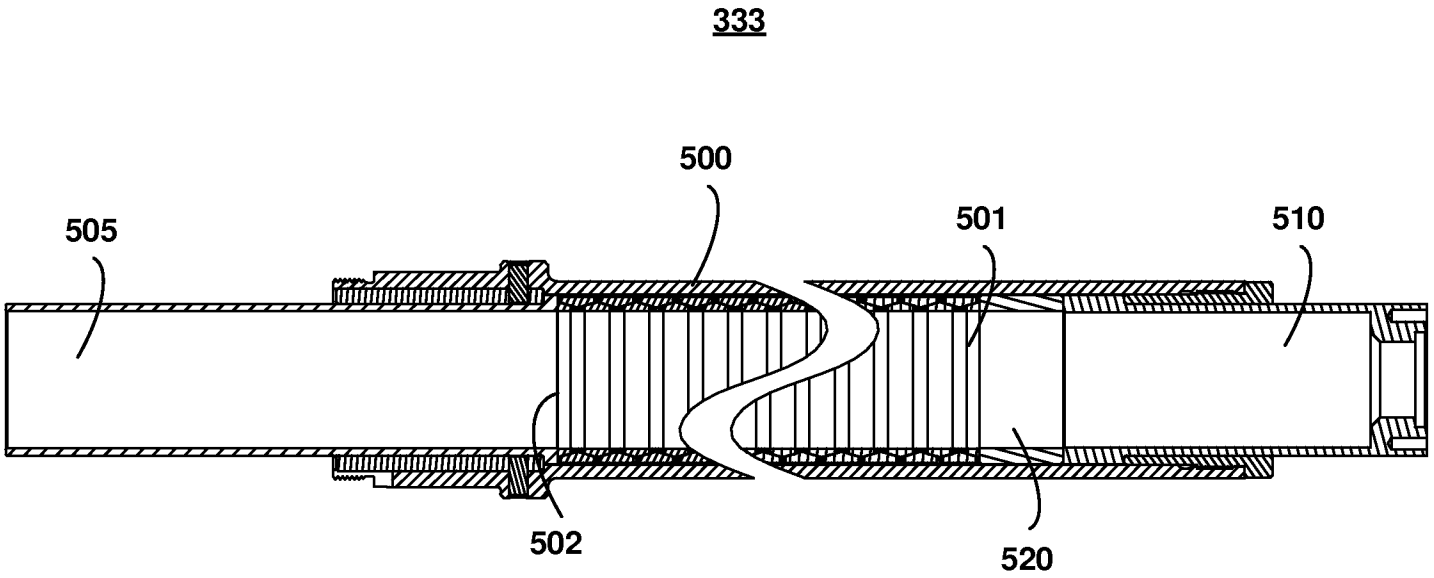
FIG. 5 is an enlarged, partly cross-sectional, fragmented view of the bi-directional recoil mechanism of FIG. 4A, taken along line 5-5 thereof, wherein two cylinders are used in this embodiment of the weapon system.

FIG. 5 is an enlarged, partly cross-sectional, fragmented view of a representative piston 405 of the bi-directional recoil mechanism 333 of FIG. 4A, taken along line 5-5 thereof. The piston 405 is generally formed of a hollow, tubular ring spring cylinder 500, within which ring springs 501 are allowed to be compressed, bi-directionally, between a forward end 502 of a recoil piston 505 and a ring spring preload spacer 520 of a counter-recoil piston 510. The forward end 502 and the ring spring preload spacer 520 act as compression walls for the ring springs 501, to limit their bi-directional range of travel within the ring spring cylinder 500, as further illustrated in FIG. 6.

Figure 6:
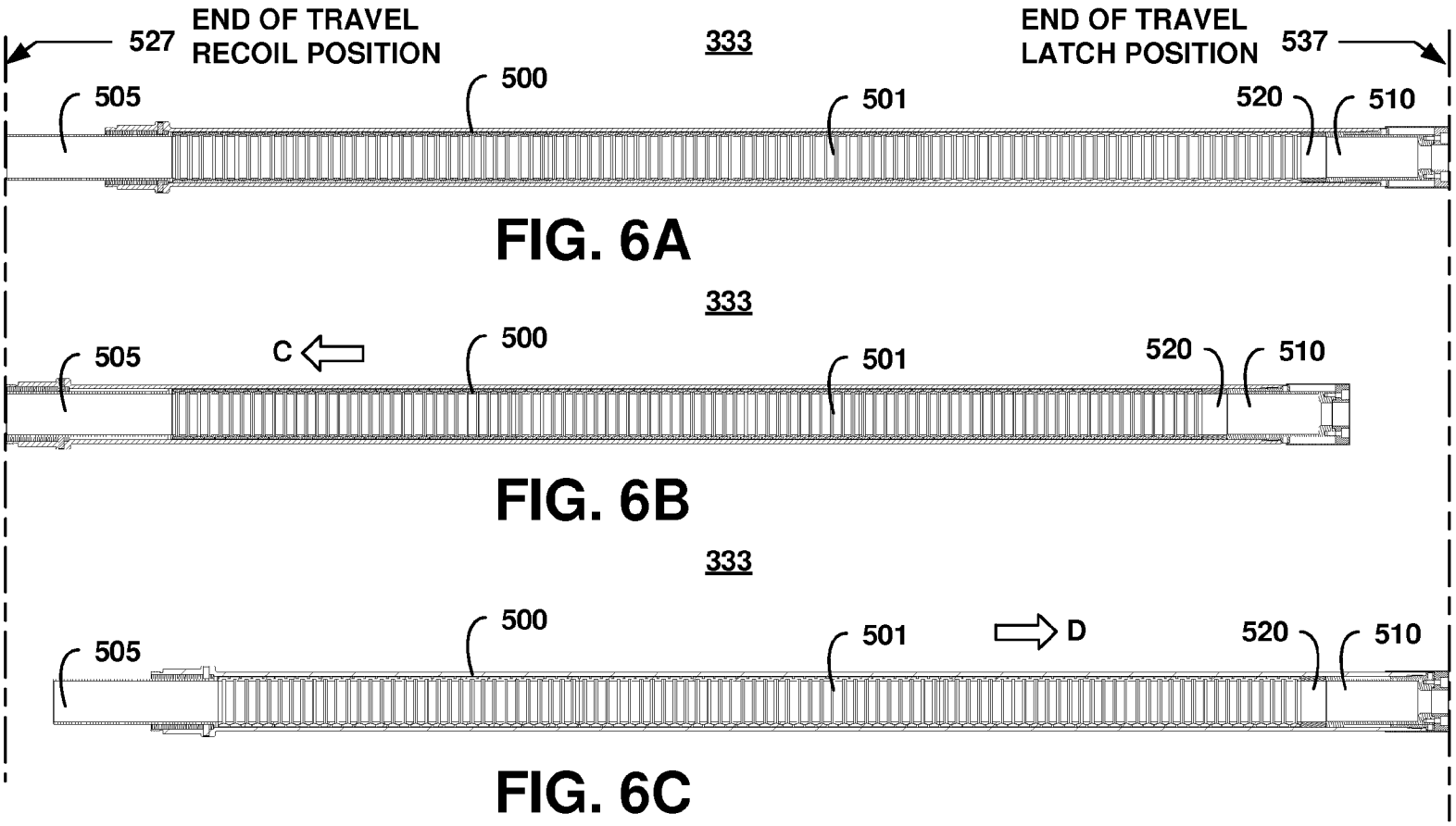
FIG. 6 includes FIGS. 6A, 6B, and 6C, and represents the piston of FIG. 5, in a free state (FIG. 6A), in a recoil state (FIG. 6B), and in a counter-recoil state (FIG. 6C)

FIG. 6 includes FIGS. 6A, 6B, and 6C, and represents the bi-directional recoil system used in pistons 405 and 420 of FIG. 4A in an uncompressed state (FIG. 6A), in a recoil state (FIG. 6B), and in a counter-recoil state (FIG. 6C). In the uncompressed state of FIG. 6A, the uncompressed ring springs 501 are unbiased and extend axially, within the ring spring cylinder 500, with the farthest extremity 507 of the recoil piston 505 resting (or pressing) against a wall 527 that marks the end of travel of the recoil position, and a latch mechanism that is represented by a wall 537 that marks the end of travel of the latch (or counter-recoil) position.

With reference to FIG. 6B, as the recoiling mass 20, including the bi-directional recoil mechanism 333, moves rearward along the arrow C, the piston 405 contacts the stationary weapon cradle (not shown), thereby compressing the energy-absorbing ring springs 501 inside the recoil piston 405.

With reference to FIG. 6C, After absorbing much (but not all) of the rearward momentum, the ring springs 501 propel the recoiling mass 20 forward along the arrow D, against the latch mechanism 537. The counter-recoil piston 415 contacts the latch mechanism 537, subsequently compressing the ring springs 501 from the opposite direction, thereby absorbing the forward momentum and significantly reducing the forces experienced by the Latch mechanism 537.

The recoil state of FIG. 6B and the counter-recoil state of FIG. 6C of this cycle oscillate, thereby dampening the recoil and counter-recoil energy, until all residual energy has been absorbed, and the piston 405 is returned to the free state of FIG. 6A.

While the recoil mass 20 has been described as comprising four pistons 405, 410, 415, 420, two of which are bi-directional recoil mechanism cylinders 333, it should be understood that a different number of pistons may be selected, depending on the intended application for the force mitigation. In addition, while in this exemplary embodiment the bi-directional recoil mechanism 333 is illustrated as including two similar pistons 405, 420, as comprising the bidirectional dampening feature as described in connection with FIG. 6, while the remaining two pistons 405, 410 are not provided with such feature, it should be understood that exemplary design has been provided for the sake of explanation and a different number of pistons may be provided with the bidirectional dampening feature.

The need to maintain relatively low recoiling loads, enables the weapon 5 in military applications, and other loads in commercial applications, to be mounted onto light mobile platforms. However, other factors still need to considered for further improving the present invention. These factors include, without limitation: ignition delays, the ability to react to abnormally high impulses, the ability to perform at greater temperature extremes, and the ability to perform at greater weapon cant.

Ignition delays may, in extreme cases, defeat the advantages of soft recoil. As an example, by the time the mortar cartridge 11 ignites, the forward momentum of the recoiling mass 20 is reduced to zero. In this case, the recoil forces increase significantly, making the weapon 5 less practical for light mobile platforms. Prior weapons 5 have addressed this problem by allowing the combustion gases to vent past the breech seal, thereby reducing the rearward momentum. However, this arrangement may, under certain circumstances, reduce the muzzle velocity of the projectile 11, resulting in the projectile 11 falling unacceptably short of its intended target, and possibly endangering friendly troops or civilians in the vicinity.

To address the ignition delays and other related concerns, the present invention provides a novel double strike prevention system 300 illustrated in FIGS. 3, 4A, 4B, and 7 through 13.

FIG. 3 further illustrates the automated weapon 5 of FIG. 1A as including the double strike prevention system 300. The double strike prevention system 300 is generally comprised of a pin retraction mechanism 307 (Detail A) that extends forward from the recoil mass 20, to a firing pin assembly 308 (DETAIL B). The firing pin assembly 308 extends to the aft section of the projectile 11.

In general, the double strike prevention system 300 enables safer and automatic retraction of the firing pin 456 (FIGS. 4B, 8) and reduces the potential for unintentionally striking a primer 1110 (shown in dashed lines in FIG. 13) and unintentional initiation of the round 11 during misfire operations. More specifically, the pin retraction mechanism 300 is designed to perform at least two main functions.

The first function is to render the firing pin 456 easily accessible and removable, in order to introduce an added degree of safety. This function is useful for transport, misfire procedure, maintenance, and in general, to render the weapon 5 safer to operate because of the inability of the firing pin 456 to strike the primer 1110.

The second function is the automatic, self-retraction feature of the firing pin 456, according to which the firing pin 456 automatically retracts within the firing pin assembly 308 and thus becomes unable to initiate the primer 1110.

An exemplary situation in which the firing pin of a conventional weapon presents a danger of double striking the round, is where the round is fired at a steep elevation, e.g., around 80 degrees above horizontal. In the event that the firing pin 456 does not ignite the propellant and the round 11 travels upward, not ignited, within the gun tube 30, the firing pin remains extended from the firing pin assembly. As the round 11 falls back under gravity, it is bound to strike the extended firing pin 456. The danger emanates from the fact that the forward velocity of the breech 444 significantly dissipates, causing the round 11 to exit the gun tube 30 while sending the breech 444 rearward at higher velocities than normal. In general, the rearward velocity of the breech 444 is the difference between its forward velocity prior to igniting the round 11, and the velocity obtained with no soft recoil effect in traditional recoil systems.

Essentially, the firing pin 456 of the present invention automatically starts to extend from the recoil mass 20 after the round 11 enters the gun tube 30. Upon completion of the firing pin 456 striking the round 11, the firing pin 456 automatically starts to retract within the recoil mass 20.

Considering now the double strike prevention system 300 in more detail, in connection with FIGS. 4B, and 7 through 11, it forms part of the rammer 444. FIG. 7 illustrates the pin retraction mechanism 307 as including a cam profile that regulates the operation of a firing cam 709 and a safeing cam 705, by means of a firing cam path 701 and a safeing cam path 702, respectively. The firing cam rocker 709 employs a firing cam roller 706 to roll along the firing cam path 701. Similarly, the safeing cam rocker705 employs a safeing cam roller 711 to roll along the safeing cam path 702.

The pin retraction mechanism 307 is disposed at the rear section of the recoil mass 20. It is held by a rear bracket 425, and forms part of the rammer 444.

To further explain the details of the operation of the double strike prevention system 300, the operations of the double strike prevention system 300 and the firing pin assembly 900 will now be described in connection with the following sets of drawings, {FIGS. 7, 9-11} and {FIG. 8}, respectively.

FIG. 7 illustrates the progression of the four cam stages of the weapon firing cycle, and FIG. 8 illustrates the four stages of the firing pin stroke that respectively correspond to the four stages of the pin retraction mechanism 307.

Figure 7A:
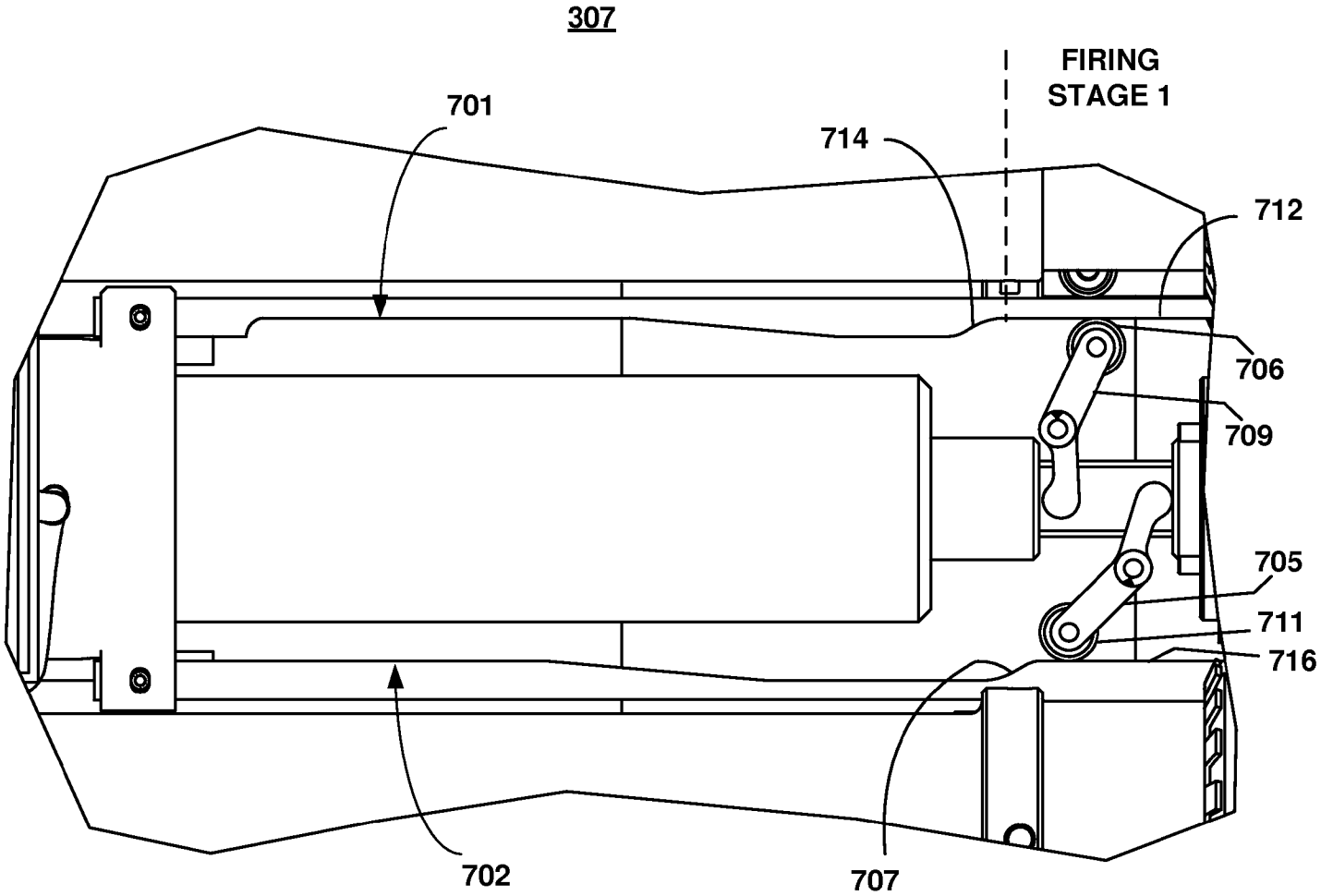
FIG. 7 includes FIGS. 7A, 7B, 7C, and 7D that illustrate the four stages of the pin retraction mechanism (Detail A of FIG. 3)
Figure 8A:
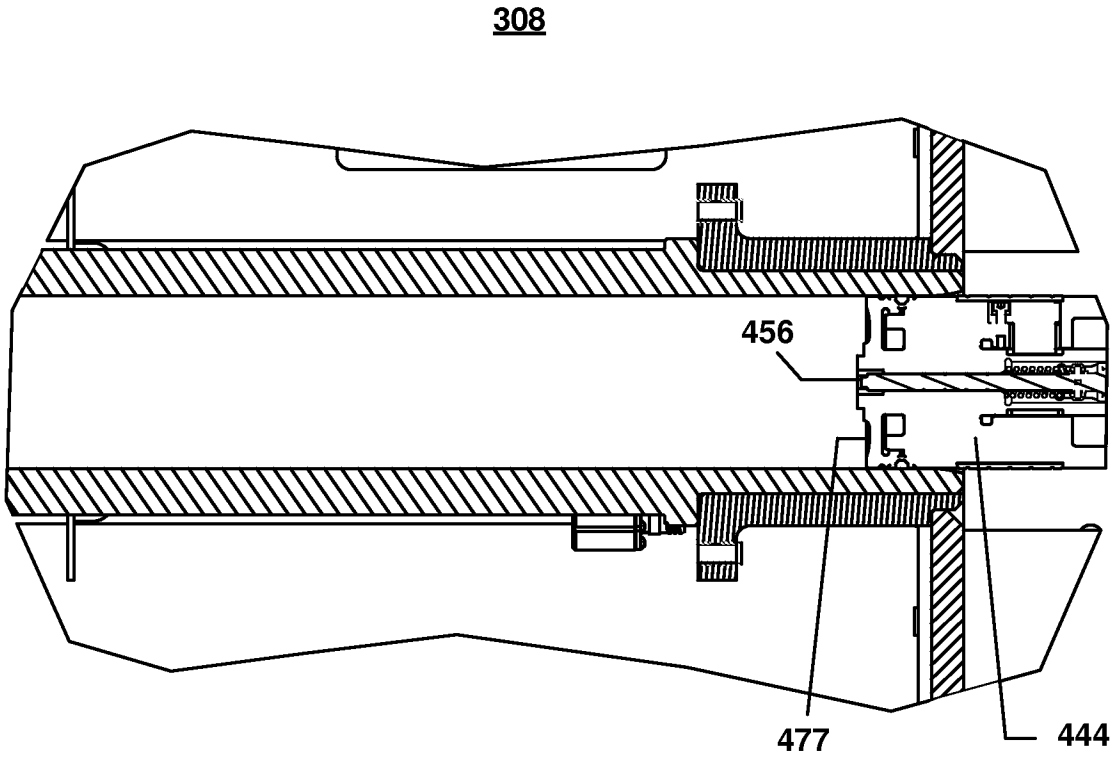
FIG. 8 includes FIGS. 8A, 8B, 8C, and 8D that illustrate the four stages of the firing pin stroke (Detail B of FIG. 3), it being understood that the four stages of FIG. 8 respectively correspond to the four stages of FIGS. 1 and 7.

FIG. 7A illustrates the double strike prevention system 300 in a safe state (or position), which further corresponds to FIGS. 1A and 6A. In this first stage, the pin retraction mechanism 307 is stationary relative to the rammer 444 and the firing pin 456 is retracted inwardly from the forward face 477 of the rammer 444 (FIGS. 4B, 8A). The safing cam roller 711 is shown riding a first high profile 716 of the sating cam path 702, while the firing cam roller 706 is shown riding a first low profile 712 of the fireing cam path 701.

Figure 7B:
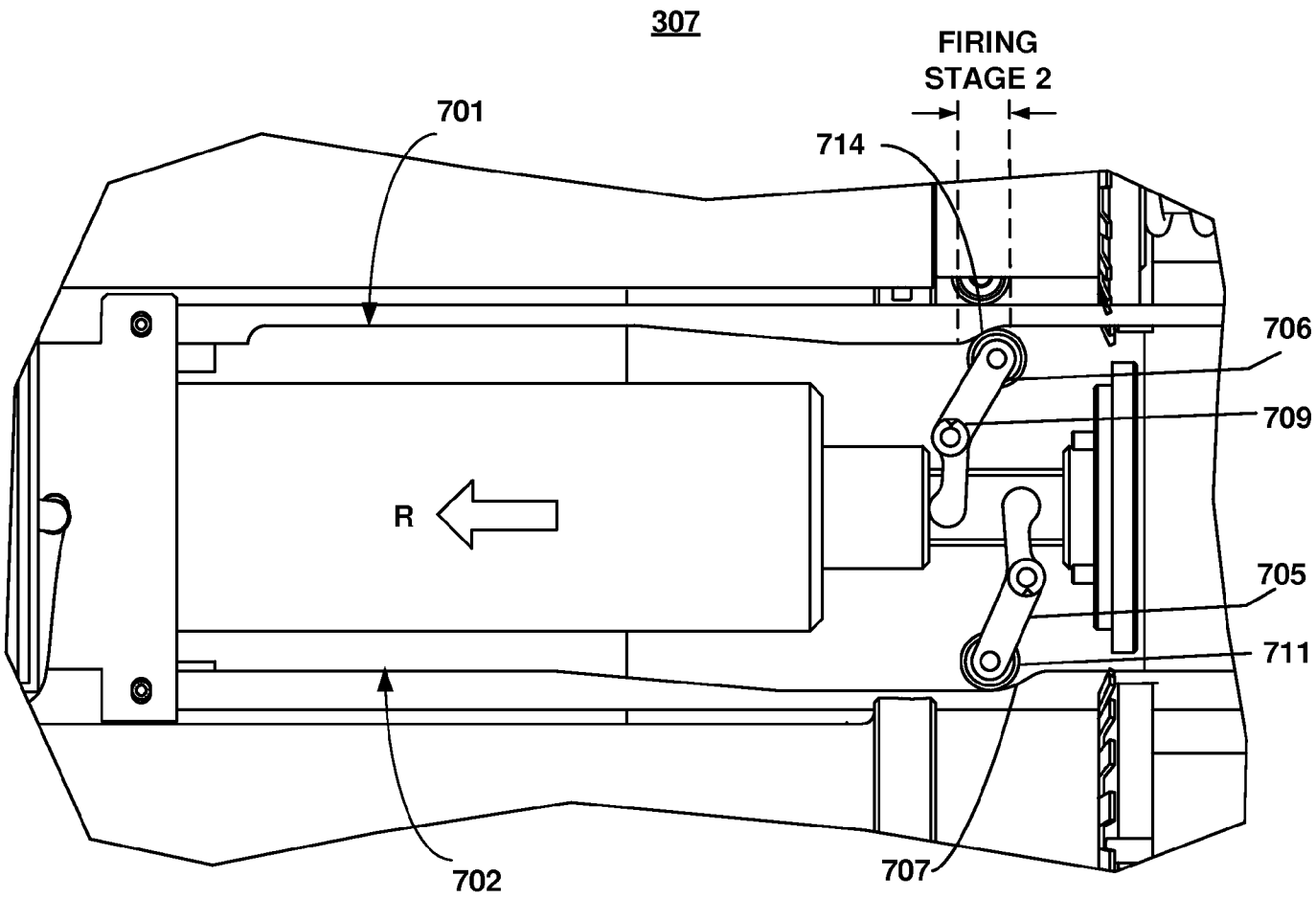
Figure 8B:
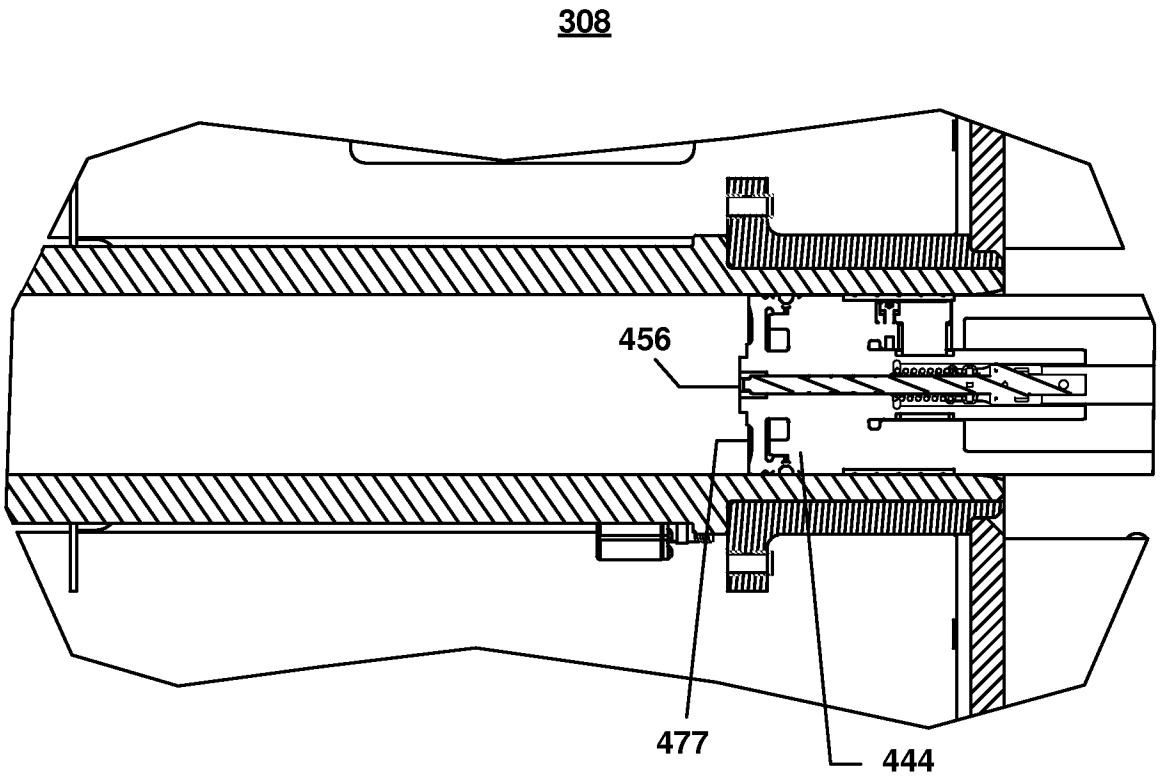

FIGS. 7B and 8B illustrate the second firing stage, namely the pre-recoil stage (or the initial firing pin activation position). In this state, the pin retraction mechanism 307 is forced to travel in the direction of the arrow R by means of contact between the firing pin guide 999 and the firing cam 709, entrailing the firing cam rocker 709 and the safeing cam rocker705 along their respective cam paths 701, 702.

Accordingly, the safeing cam roller 711 reaches a low profile section 707 of the safeing cam path 701, and the firing cam roller 706 reaches a high profile section 714 of the firing cam path 701. At this stage, the firing pin (456) safety is removed and the firing pin 456 starts to protrude from the rammer 444 (FIG. 4B). The contact between the firing cam path 701 and the firing cam roller 706 causes the firing cam rocker 709 to rotate clockwise. This rotation creates contact pressure on the firing pin guide 999, causing it to translate axially toward the gun tube 30. The fining pin assembly 900 is contained within the firing pin guide 999, allowing for co-axial translation.

Figure 7C:
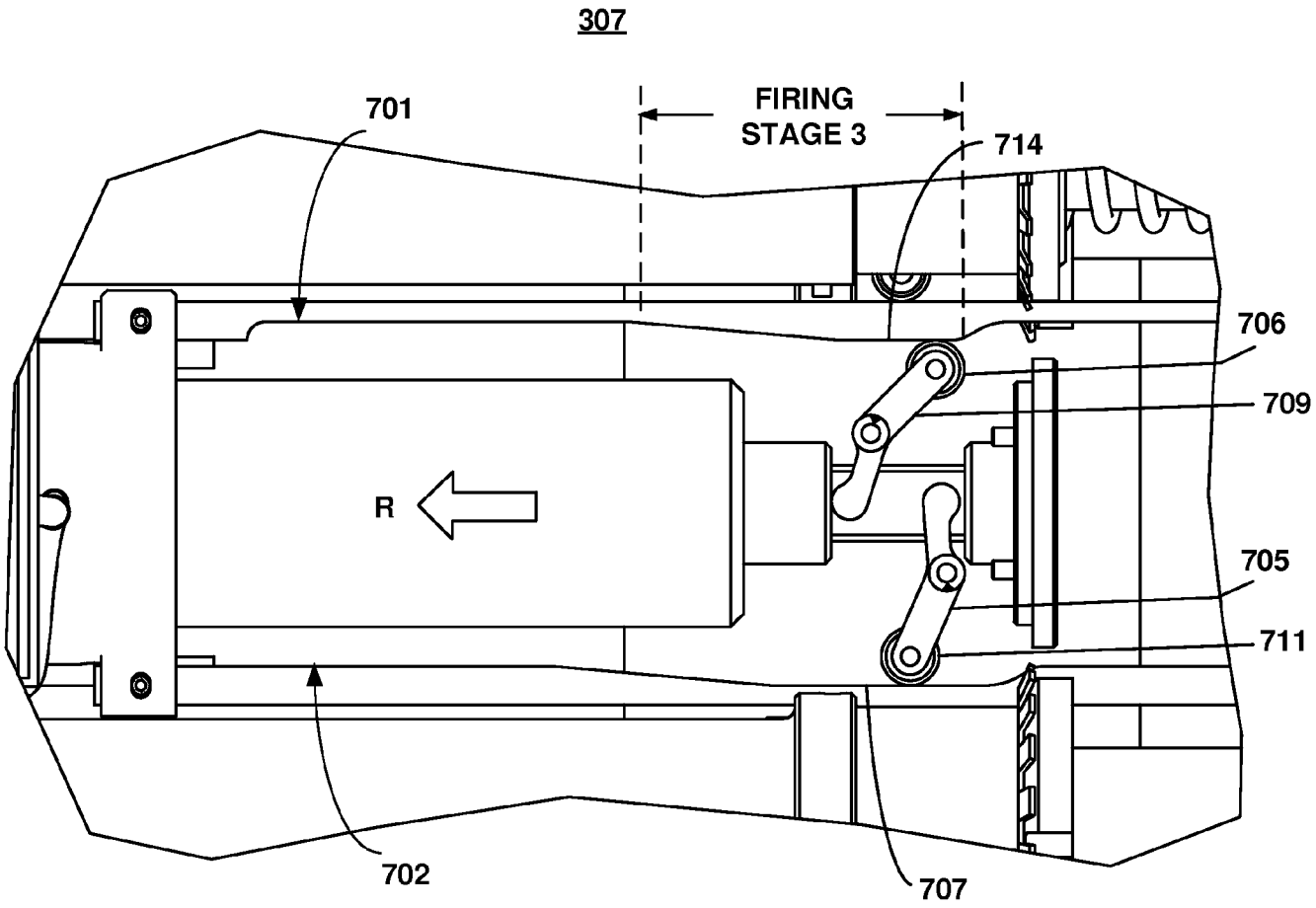
Figure 8C:
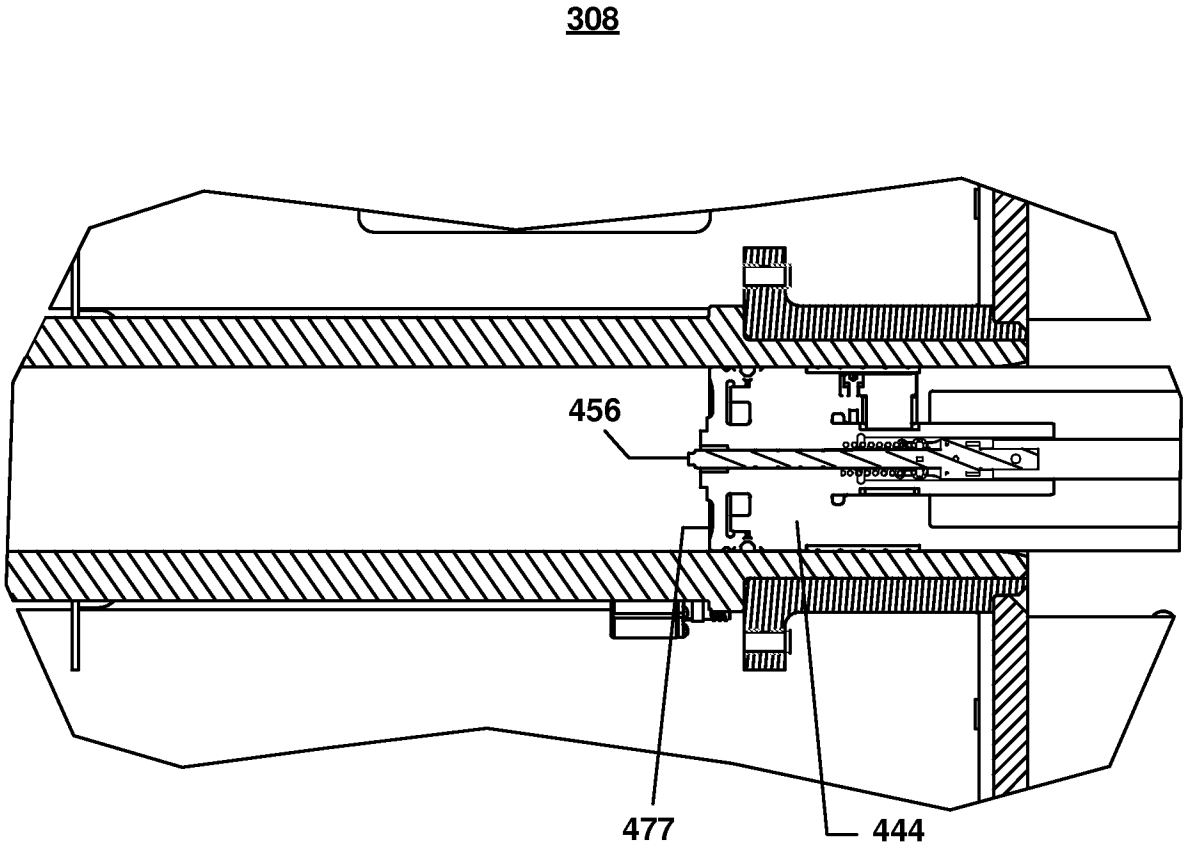

FIGS. 7C and 8C illustrate the third firing stage, namely the recoil stage (or the firing pin fully activated position), which further corresponds to the recoil stages shown in FIGS. 1B, and 6A. At this stage, the pin retraction mechanism 307 is forced to further travel in the direction of the arrow R, further entrailing the firing cam 709 and the safeing cam 705 along their respective cam paths 702, 701.

Accordingly, the safeing cam roller 711 travels along the low profile section 707 of the safing cam path 702, and the firing cam roller 706 travels along the high profile 714 of the firing cam path 701. At this stage, the firing pin 456 is fully extended from the firing pin assembly 308 (FIG. 8C), and striking the primer 1110. The contact between the safeing cam path 701 and the safeing cam roller 706 causes the safeing cam 705 to rotate clockwise. This rotation creates contact pressure on the firing pin guide 999, causing it to translate axially toward the gun tube 30. Under normal operating conditions, the ignition of the propellant in the round, will create enough force to stop the recoil mass and reverse its direction prior to entering into the fourth stage.

Figure 7D:
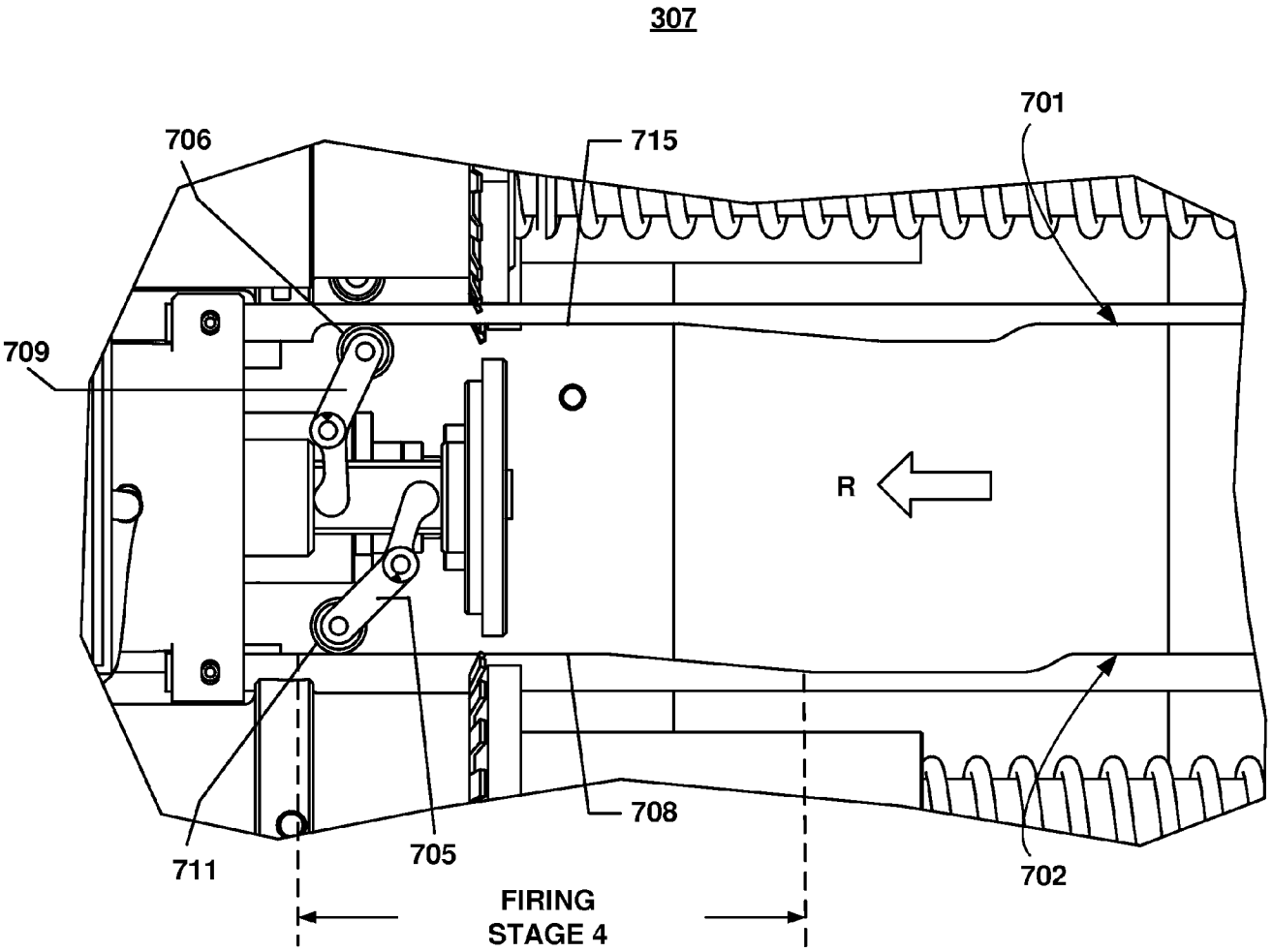
Figure 8D:
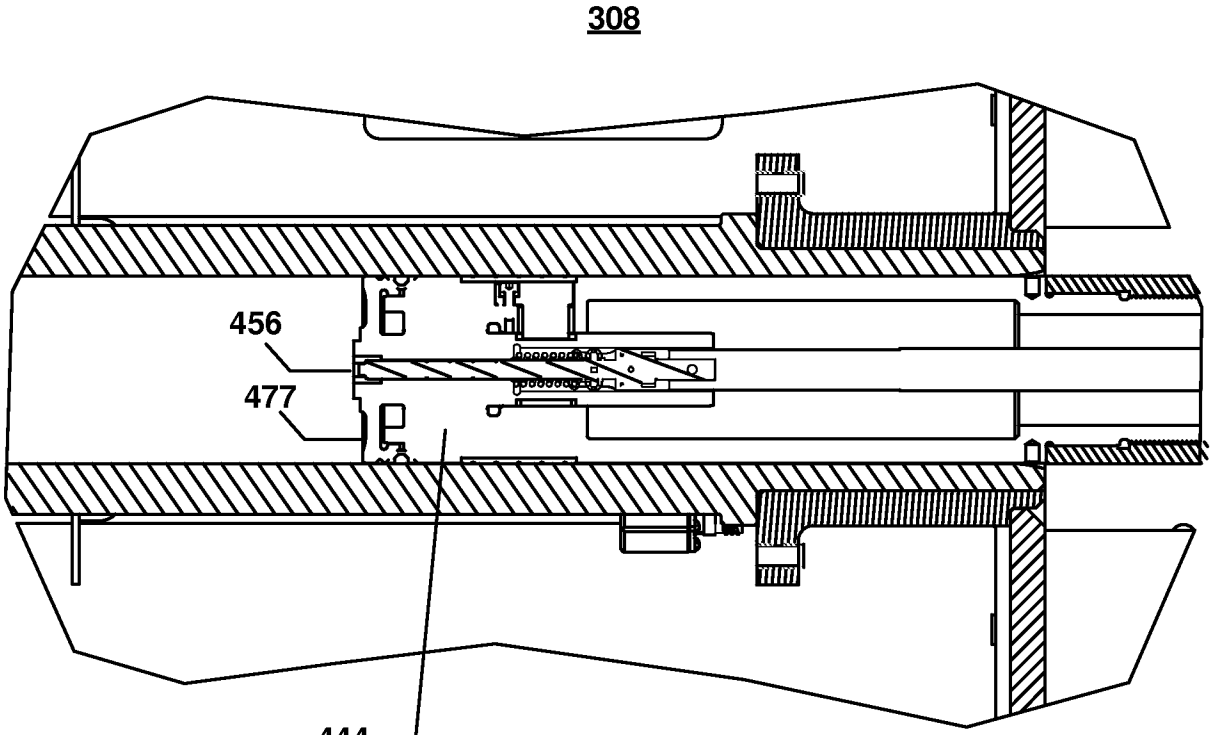
Figure 9:
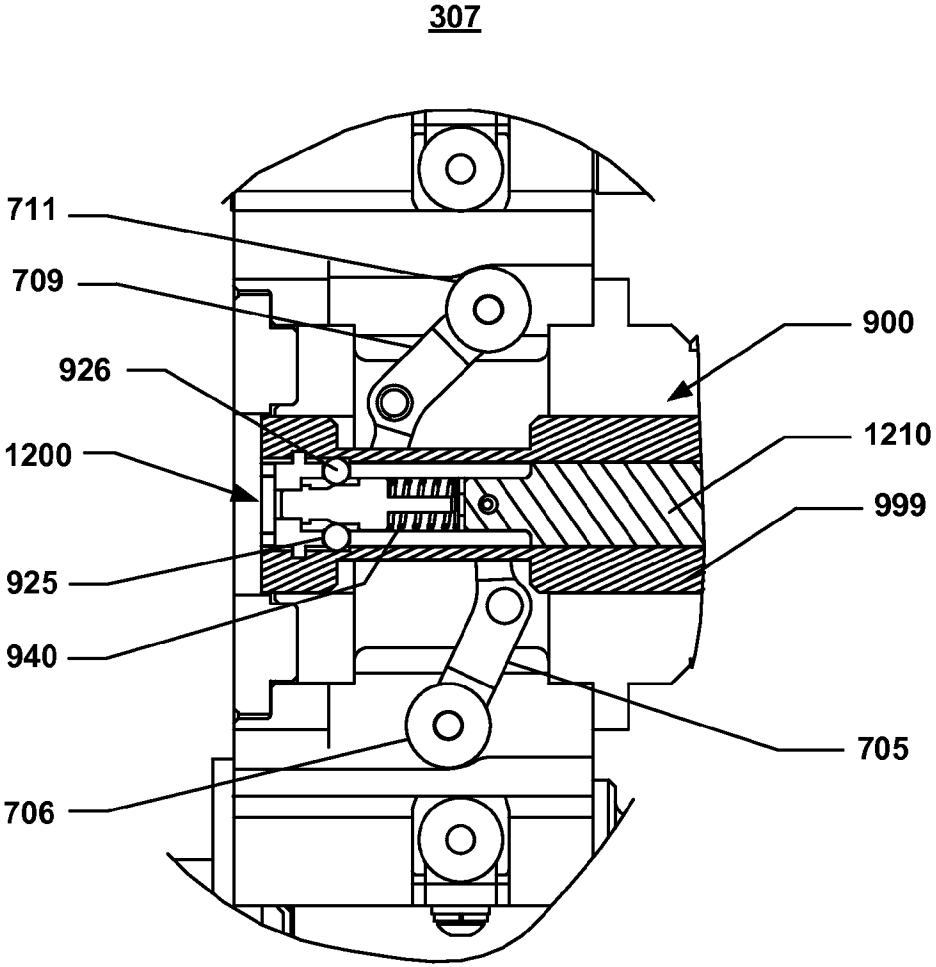
FIG. 9 is an enlarged, partly cross-sectional view of the pin retraction mechanism (Detail A of FIG. 3), further illustrating a firing pin locking assembly that includes a cam assembly.

FIGS. 7D and 8D illustrate the fourth firing stage, namely the safety state (or position). This stage is only activated if there is in sufficient propelling force generated from stage three, i.e. a misfire or extremely late ignition. In the fourth stage, the pin retraction mechanism 307 is forced to travel farther in the direction of the arrow R, further entrailing the firing cam rocker 709 and the safeing cam rocker 705 along their respective cam paths 701, 702.

Accordingly, the safeing cam rocker 705 reaches and continues to travel on a second high profile section 708 of the safeing cam path 702, and the firing cam rocker 709 reaches and continues to travels on a second low profile section 715 of the firing cam path 701. In this state, the firing pin 456 is fully retracted back inside the rammer 444 (FIG. 8D), preventing the firing pin 456 from striking the primer 1110. The contact between the safeing cam roller 711 and the safeing cam path 702 causes the safeing cam rocker 705 to rotate clockwise. This create contact pressure between the firing pin guide 999 and the safeing cam rocker 705, which causes the firing pin guide 999 to translate axially entrailing the firing pin assembly 900 away from the gun muzzle.

During the recoil operation of the weapon 5 (FIG. 1C), the above four stages are reversed so that they follow the order: Stages 4, 3, 2, and then 1.

In summary, as the recoiling mass 20 is moving forward, the firing cam rocker 709 and the safeing cam rocker 705 travel along their respective stationary cam paths 702, 701, by means of rollers 706, 711. The cam paths 701, 702 control the motion of the firing cam rocker 709 and the safeing cam rocker 705 during the forward and subsequent backward motion of the recoiling mass 20. The motion of the safeing cam rocker 705 prevents the firing pin 456 from protruding until the recoiling mass 20 has moved to a position where pin protrusion (and subsequent mortar cartridge ignition) is desirable. When the recoiling mass 20 has reached the desirable firing position, the safeing cam rocker 705 will rotate out of the way, allowing the firing cam rocker 709 to independently rotate, permitting the firing pin 456 to protrude, thereby causing ignition of the round 11.

In the event of a misfire, in which the round 11 does not ignite as expected, the recoiling mass 20 will subsequently translate further forward than during normal cartridge ignition. In this event, the firing cam rocker 709 will rotate back, allowing the safeing cam rocker 705 to pull the firing pin 456 to its retracted position. This is a significant safety improvement over prior fielded systems. First, it guarantees that the firing pin 456 is safely retracted, preventing an inadvertent ignition. Second, when firing at high quadrant elevation, it protects the weapon 5 from experiencing high recoil forces (after forward motion of the recoil system has stopped) as a result of the round 11 dropping back onto the firing pin 456 and initiating.

The pressure created by the ignition of the propellant gases will launch the round 11 forward and will launch the recoiling mass 20 rearward, against the force created by the compression springs. During this rearward motion, the safeing cam rocker 705 and firing cam rocker 709 will return to their initial positions. The recoiling mass 20 is returned to its initial out-of-battery position, and the latch mechanism will capture the recoiling mass 20, preventing it from moving forward, and setting the weapon 5 to fire a subsequent round, i.e., 12.

With reference to FIGS. 9 through 12, the pin retraction mechanism 307 of the present invention additionally incorporates a firing pin locking assembly 900 that enables the manual removal of the firing pin 456, for safety, maintenance, and inspection purposes. The firing pin retraction mechanism 307 is generally disposed within the rear bracket 425 (FIG. 4A), in proximity to the firing cam path 701 and the safeing cam path 702 (FIG. 7).

The firing pin locking assembly 900 generally includes a cam assembly 1200 (FIG. 12) that is housed within a firing pin guide 999, and a firing pin twist lock 1215 that has a hollow, cylindrical shape. The cam assembly 1200 can be locked to the housing 999 by means of two quarter-turn threads 1235, 1236. Two similar, externally protruding quarter-turn threads 1235, 1236 are disposed diametrically opposed to each other on the firing pin twist lock 1215 of the cam assembly 1200. The two threads 1235, 1236 are capable of rotating 90 degrees to engage two corresponding slots in the firing pin guide 999, for retaining the firing pin locking assembly 900 within the housing 999.

The cam assembly 1200 further includes two detente balls 925, 926 that engage two diametrically opposed cavities 946 in the wall of the housing 999. A spring tension pin 1212 inserts vertically through two diametrically opposed holes 1232 formed through the wall of the firing pin twist lock 1215 and into the hole in the extension bar 1210, so that when the firing pin locking assembly 900 is assembled, the spring tension pin 1212 holds the entire assembly 900 together.

Figure 10A:
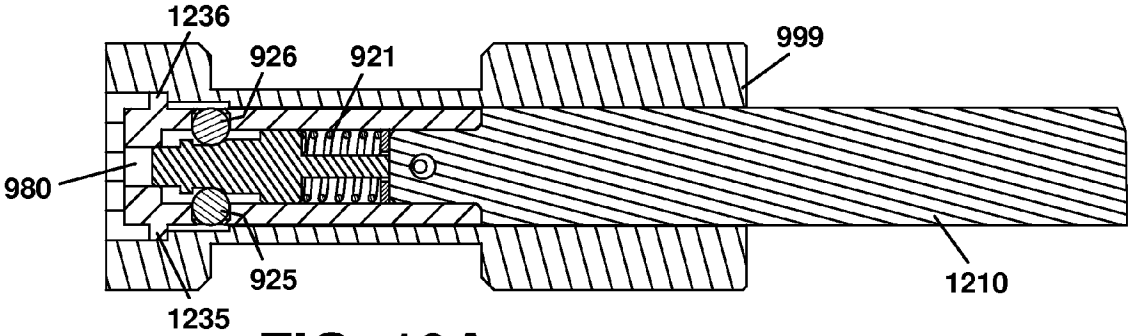
Figure 10B:
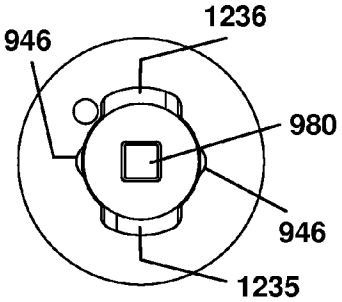
FIG. 10B is a rear view of the firing pin locking assembly of FIG. 10A.
Figure 11A:
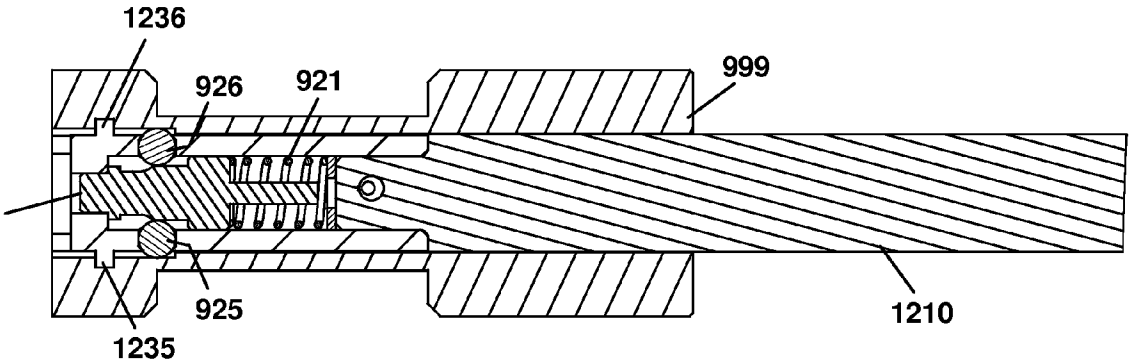
Figure 11B:
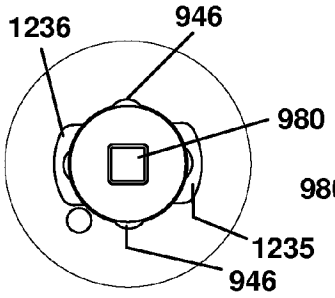
FIG. 11B is a rear elevational view of the firing pin locking assembly of FIG. 11A.
Figure 12:
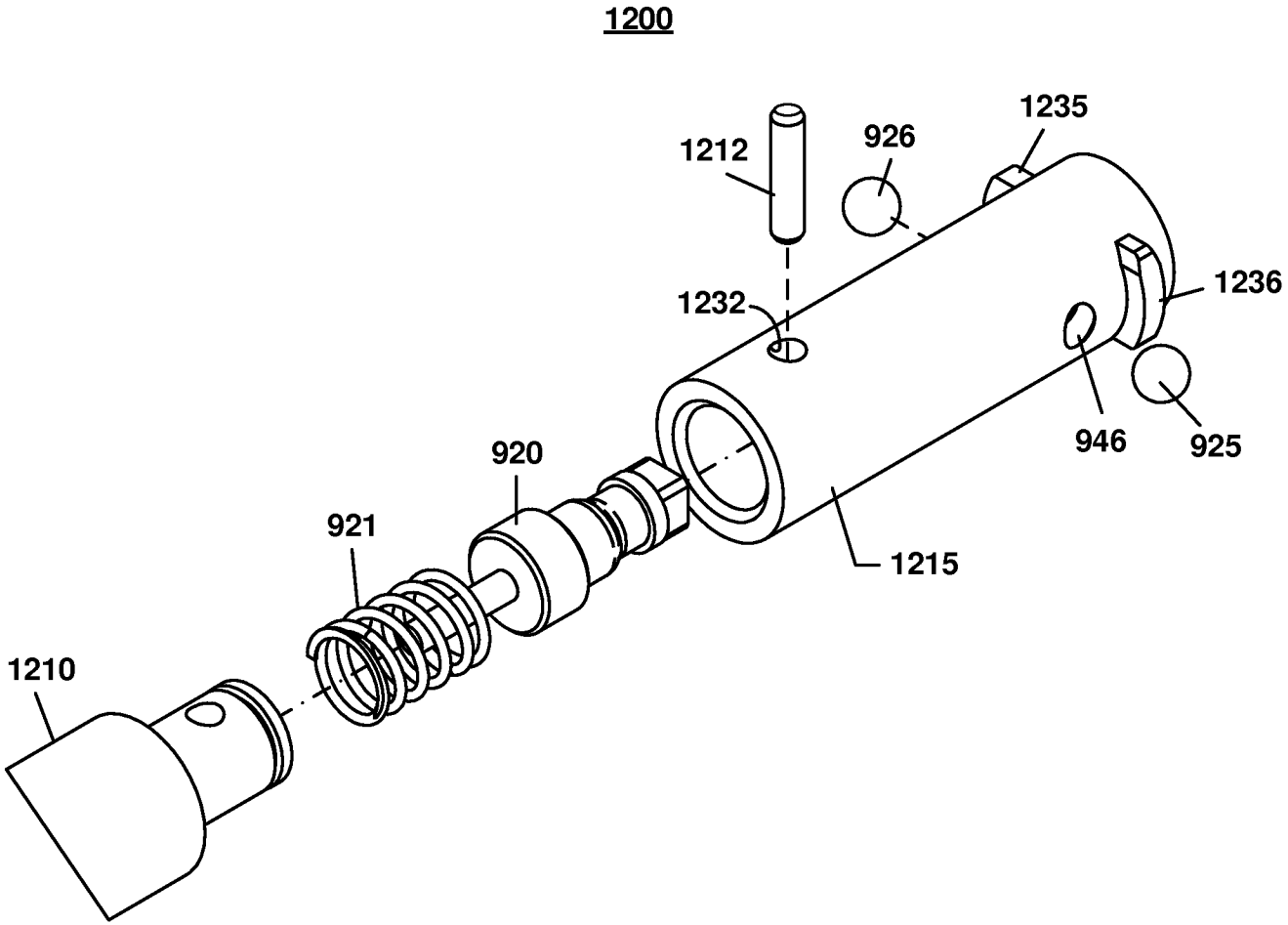
FIG. 12 is an exploded, isometric view of the cam assembly of the firing pin locking assembly of FIGS. 9 through 11.
Figure 13:
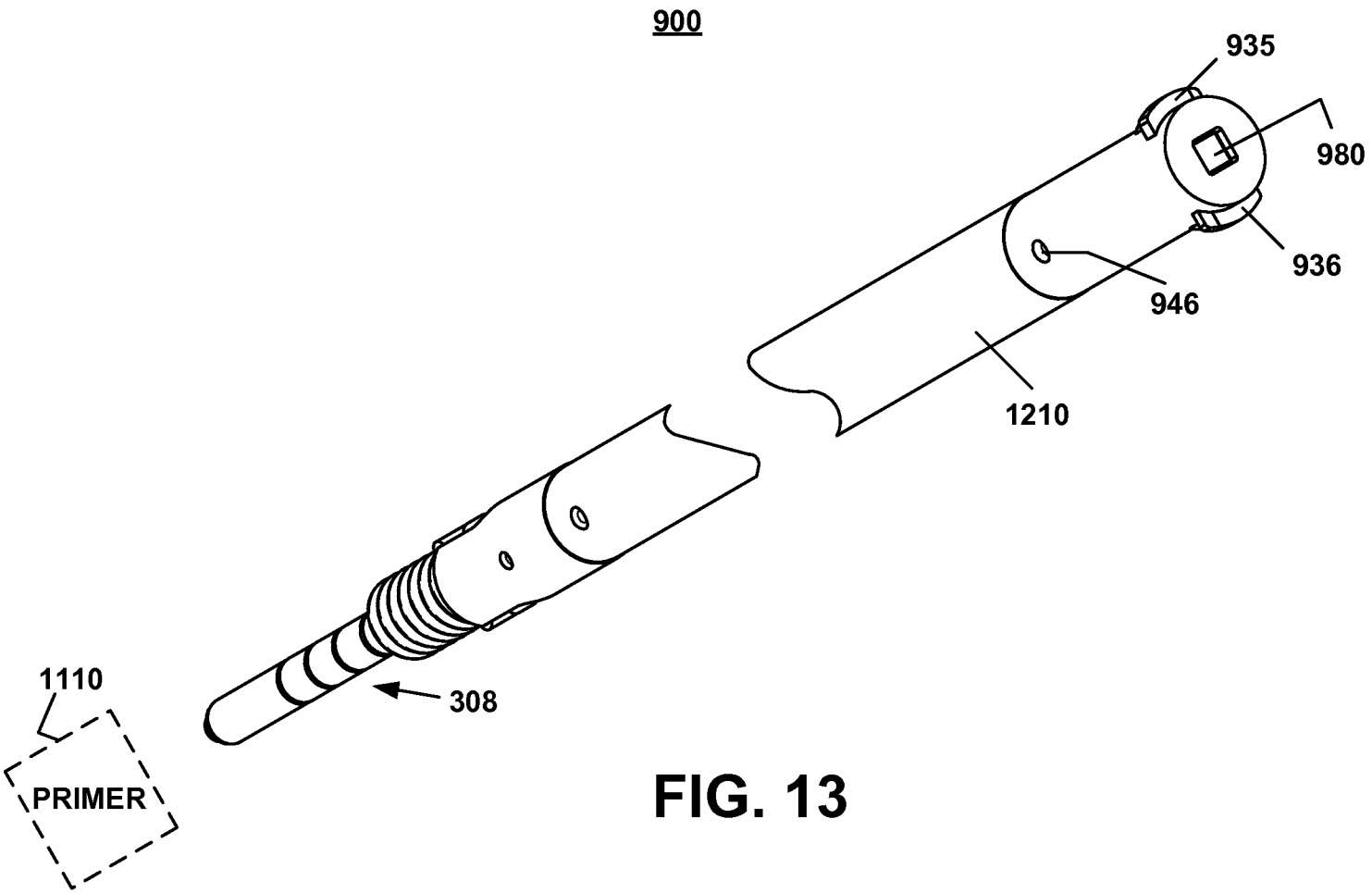
FIG. 13 is a fully assembled, fragmented, isometric view of the firing pin locking assembly of FIGS. 9 and 12, further illustrating the firing pin assembly.

A firing pin removal (or anti-rotation) cam 920 provides a caming surface for the detente balls 925, 926, and provides a convenient means to access to the firing pin locking assembly 900, by means of a square socket port 980 (FIGS. 10B, 11B). The firing pin removal cam 920 is located within the firing pin twist lock 1215 and rotates with the cam assembly 1200 relative to the firing pin guide 999.

When it is desired to remove the firing pin 456, a square shaped socket is inserted in the socket port 980 and rotated ninety degrees counterclockwise. The axial force on the firing pin removal cam 920 compresses a compression spring 921, which, in turn, acts against an extension bar 1210. The compression of the spring 921 causes the firing pin removal cam 920 to translate axial towards the muzzle, and the two detente balls 925, 926 to roll along the profile of the firing pin removal cam 920.

When the firing pin removal cam 920 is pushed forward against the preload of the compression spring 921, the two detente balls 925, 926 are permitted to fall inward, thereby permitting the rotation of the firing pin locking assembly 900 relative to the firing pin guide 999. A compression spring attached to firing pin assembly 308 forces axial motion rearward to allow an operator to grab the firing pin locking assembly 900 and to remove it. The removal of the firing mechanism is typically required when transporting the weapon 5, for inspection of the firing pin 456, or for safety purposes in the event of a misfire.

Figure 14:
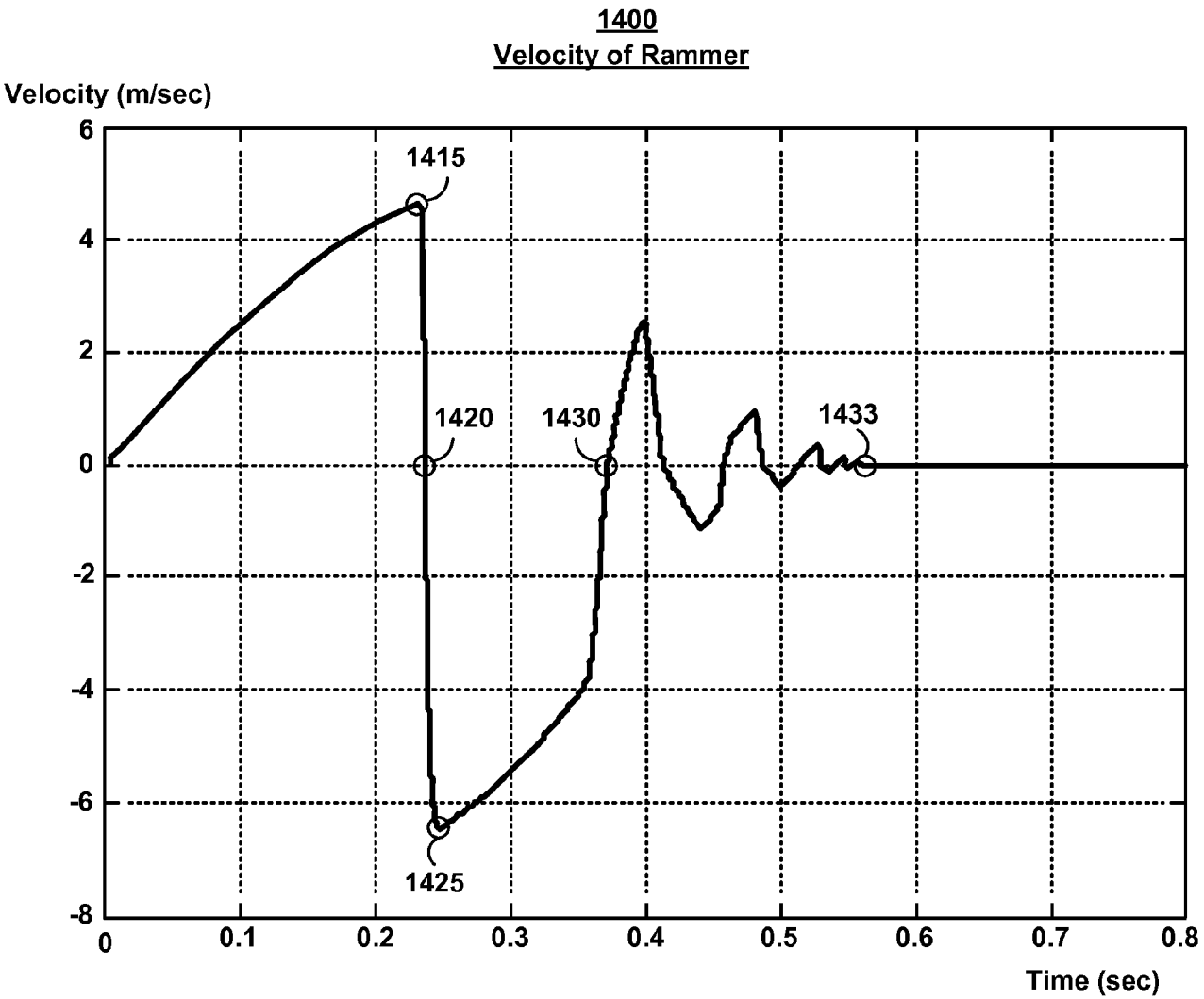
FIG. 14 is a graph that illustrates the velocity of the rammer with respect to time during the firing cycle of the weapon.

FIG. 14 is a graph 1400 that illustrates the velocity of the recoil mass 20 with respect to time. The recoil mass 20 starts at the initial latched position, which is the zero position (0, 0), at which position, the recoil mass 20 has zero velocity at time t=0. As time progresses, the latch is released, and the recoil mass 20 is propelled forward, gaining velocity as it accelerates. The rammer 444 with attached moving breach moves a fixed amount into the gun tube. It is at this moment that the firing pin locking assembly 900 is forced to extend from recoiling mass 20 and ignite the round. Pressure builds which first slows the forward motion of the recoil mass 20, and eventually change its travel direction. This deflection point is referred to by the numeral reference 1415.

At the inflection point 1415, the rammer velocity starts to decrease very quickly (almost instantaneously), and it passes through the zero velocity point (1420), at which the rammer 444 is said to have made an instantaneous stop. The rammer 444 then gains acceleration rearward, acquiring a negative velocity, until it reaches a point of maximum speed (1425). The rammer velocity then decreases in absolute value until it stops at the zero position (1430), and then continues to move in the forward direction. The bi-directional recoil mechanism 333 then travels back and forth from the recoil position to the counter recoil position, slowly damping out any residual energy until the recoil mass 20 comes to a complete stop (1433), at around 0.55 seconds. At this time, the second round 12 will be advanced in line with the gun tube 30 and ready for firing.

Figure 15:
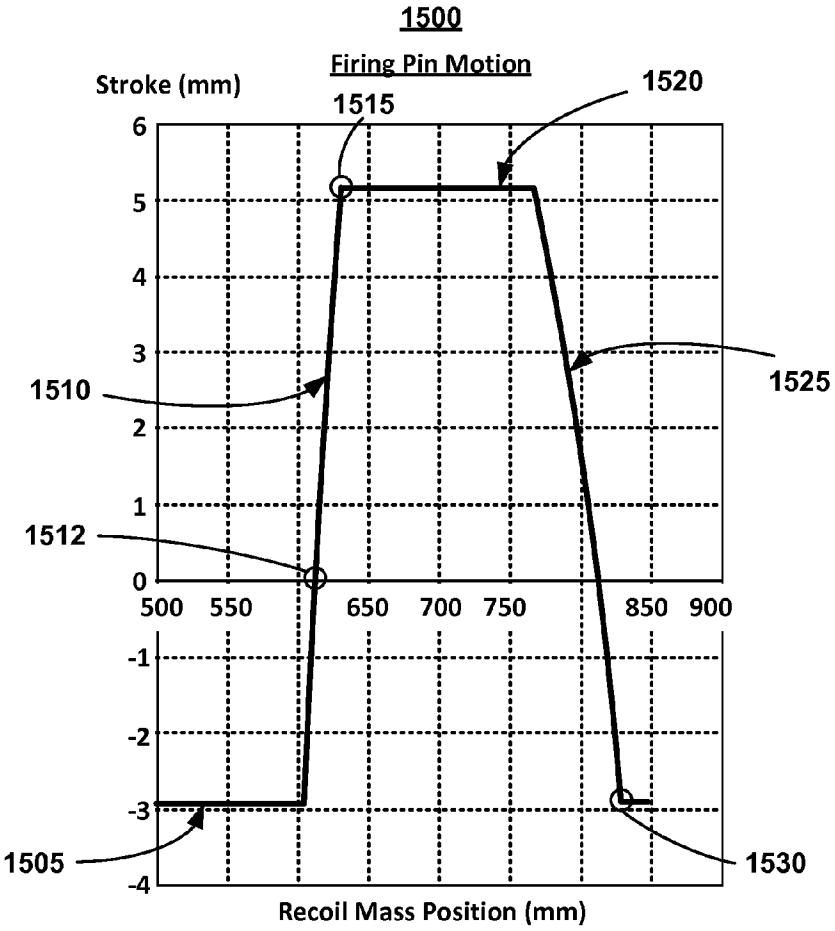
FIG. 15 is a graph that illustrates the motion of the firing pin during the firing cycle of the weapon.

FIG. 15 is a graph 1500 that illustrates the motion of the firing pin 456, in connection with the four firing stages of FIGS. 7 and 8, described earlier. The horizontal segment 1505 represents the first stage of the firing cycle, wherein the negative value of the stroke means that the firing pin 456 is retracted within the rammer 444.

The positively sloping segment 1510 relates to the second stage of the firing cycle, wherein the firing pin 444 starts to extend outwardly at the recoiling mass position of 612.5 mm (1512), until the firing pin 456 extends fully beyond the forward face 477 of the rammer 444 (FIGS. 4B, 8A) at 1515.

The horizontal segment 1520 relates to the third stage of the firing cycle, wherein the firing pin 456 remains extended until the completion of the propellant ignition stage.

The negatively sloping segment 1525 relates to the fourth stage of the firing cycle, wherein the firing pin 456 begins to retract, and continues retracting until it is completely retracted beneath the face 477 of the rammer 444 at 1530. This stage only occurs in the event of a failed propellant ignition or an attempt to fire without a round 11 inline with the rammer 444.

Weapons must also be designed to withstand the largest expected chamber pressure for safe operation under the most extreme operating conditions. This pressure, known as the PMP (permissible individual maximum pressure) may be typically as high as 50% greater than ambient temperature firing pressures. Statistically, these conditions may arise 3 times per 10,000 rounds fired, but result in greatly increased recoil forces. The traditional method of addressing this concern is to either increase the recoil distance to keep the forces to an acceptable level, or to design larger, more durable components. Neither solution is entirely acceptable for light mobile platforms.

Additionally, mobile platforms must be able to engage a variety of targets under various environmental extremes, with increased quadrant elevation ranges, and be able to fire at a variety of platform orientations and cants. These factors tend to require reducing the forward momentum of the recoiling parts in order to guarantee latching, which in turn results in higher recoiling forces.

Another aspect of the present invention is the incorporation of a trim brake mechanism or recoil brake 111, as stated herein. The trim brake mechanism 111 is added to address the problems associated with extreme operation conditions of the weapon 5. Briefly, the trim brake mechanism 111 is an energy absorption mechanism that controls the forward and rearward velocities of the recoiling mass 20, regardless of the firing conditions. If the forward velocity were higher than normal (due perhaps to firing with the platform facing down a hill), the trim brake mechanism 111 senses the velocity deviation resulting from such incline, and retards it to an acceptable level. If on the other hand, the rearward velocity is too high due to PMP pressure, low forward velocity, or an ignition delay, the trim brake mechanism 111 can retard it, effectively absorbing the recoil energy.

The trim brake mechanism 111 can be used both in a reactive and predictive fashion. For example, if a cant and quadrant elevation combination are known to cause increased forward velocity, a preplanned trim-braking amount can be applied. Associatively, if an increased velocity is detected, an estimated trim brake amount can be applied to negate the effect.

The incorporation of the trim brake mechanism 111 makes it possible to eliminate the need to vent propellant gases or to incorporate bulky structures to withstand higher recoil forces.

The trim brake mechanism 111 is mounted onto the weapon cradle and interfaces with the recoil mechanism by means of a straight gear rack 430 (FIG. 4A). The translational motion of the recoil system during firing, imparts rotational motion to the trim brake. A solenoid (not shown) controls the amount of force applied to the trim brake mechanism 111, thereby controlling the recoil velocity.

It is to be understood that the phraseology and terminology used herein with reference to device, mechanism, system, or element orientation (such as, for example, terms like "front", "back", "up", "down", "top", "bottom", "forward", "rearward", and the like) are only used to simplify the description of the present invention, and do not alone indicate or imply that the mechanism or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. An active soft recoil control system for use with a mortar weapon system including a breech, and an extendible firing pin, and further employing an entire recoiling mass for initiating mortar cartridge rounds at high quadrant elevation angles exceeding 80 degrees above the horizontal without a misfired round falling back and striking a stationary forward face of the breech causing damage and becoming initiated by an unretracted firing pin, the active soft recoil control system comprising:

a bi-directional recoil containment mechanism that is secured to the recoiling mass, and that includes:

a rammer;

a plurality of pistons that surround the rammer;

wherein the rammer is axially disposed relative to the plurality of pistons; and a rear bracket that engages and retains the plurality of pistons;

wherein at least one piston of the plurality of pistons includes:

a hollow, tubular cylinder:

an elastic element disposed within the cylinder, intermediate a recoil piston and a counter recoil piston;

wherein the elastic element is allowed to be compressed, axially, bi-directionally, within the cylinder, between the recoil piston and the counter-recoil piston, in order to absorb recoil energy when the recoil containment mechanism is in a recoil state, and to further absorb counter-recoil energy when the recoil containment mechanism is in a counter-recoil state;

a firing pin assembly;

a pin retraction mechanism; and wherein the pin retraction mechanism includes:

a firing cam that travels along a stationary firing cam path by means of a firing cam roller; and a safeing cam that travels along a stationary safeing cam path by means of a safeing cam roller.

2. The active soft recoil control system of claim 1, wherein the elastic element is not compressed when the bi-directional recoil containment mechanism is in a free state.

3. The active soft recoil control system of claim 2, wherein when the bi-directional recoil containment mechanism is in the recoil state, the elastic element translates axially, within the cylinder, along a recoil direction.

4. The active soft recoil control system of claim 3, wherein when the bi-directional recoil containment mechanism is in the counter-recoil state, the elastic element translates axially, within the cylinder, along a counter-recoil direction.

5. The active soft recoil control system of claim 1, wherein the plurality of pistons includes two pistons.

6. The active soft recoil control system of claim 5, wherein the plurality of pistons includes four pistons.

7. The active soft recoil control system of claim 1, wherein at least some of the plurality of pistons are similar in design and function.

8. The active soft recoil control system of claim 7, wherein at least some of the plurality of pistons are dissimilar in design and function.

9. The active soft recoil control system of claim 1, wherein the elastic element includes at least one ring spring.

10. The active soft recoil control system of claim 9, wherein said at least one piston further includes a ring spring preload spacer that acts as a compression wall for said at least one ring spring, to limit a bi-directional range of travel of the ring spring within the cylinder.

11. The active soft recoil control system of claim 1, further comprising a double strike prevention system.

12. The active soft recoil control system of claim 11, wherein the double strike prevention system includes:

the firing pin assembly; and the pin retraction mechanism that permits the firing pin to be safely removed during a misfire condition.

13. The active soft recoil control system of claim 12, wherein the pin retraction mechanism automatically retracts the firing pin at the end of a first recoil state of the bi-directional recoil containment mechanism.

14. The active soft recoil control system of claim 13, wherein the firing cam path and the safeing cam path control the motion of the firing cam and the safeing cam during a forward motion and a rearward motion of the recoiling mass.

15. The active soft recoil control system of claim 14, wherein the travel of the safeing cam prevents the firing pin from protruding until the recoiling mass has moved to a firing position where pin protrusion is desirable; and wherein as the recoiling mass has reached the firing position, the safeing cam rotate in position, to permit the firing pin to protrude.

16. The active soft recoil control system of claim 15, wherein following the protrusion of the firing pin, the pin retraction mechanism causes the firing pin to be retracted.

17. The active soft recoil control system of claim 1, further comprising a recoil brake mechanism that absorbs excess energy in order to control a forward velocity and a rearward velocity of the recoiling mass.

* * * * *